US010515748B2

(12) United States Patent
Yoshioka et al.

(10) Patent No.: US 10,515,748 B2
(45) Date of Patent: Dec. 24, 2019

(54) COIL COMPONENT

(71) Applicant: Murata Manufacturing Co., Ltd., Kyoto (JP)

(72) Inventors: Yoshimasa Yoshioka, Nagaokakyo (JP); Akinori Hamada, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 169 days.

(21) Appl. No.: 15/283,736

(22) Filed: Oct. 3, 2016

(65) Prior Publication Data

US 2017/0125153 A1 May 4, 2017

(30) Foreign Application Priority Data

Nov. 4, 2015 (JP) ..... 2015-217022

(51) Int. Cl.
*H01F 27/24* (2006.01)
*H01F 5/00* (2006.01)

(52) U.S. Cl.
CPC ..... *H01F 5/003* (2013.01)

(58) Field of Classification Search
CPC ... H01F 3/08; H01F 5/003; H01F 5/04; H01F 27/2804; H01F 27/27; H01F 27/29; H01F 27/292; H01F 17/0006; H01F 17/0033; H01F 2017/0073; H01F 2017/0066
USPC ..... 336/200, 223, 233, 192
See application file for complete search history.

(56) References Cited

U.S. PATENT DOCUMENTS

2007/0040163 A1* 2/2007 Okuzawa ..... H01F 27/292 257/31
2010/0052838 A1* 3/2010 Matsuta ..... H01F 17/0013 336/200
2010/0157565 A1* 6/2010 Yoshida ..... H01F 7/292 361/811
2011/0002075 A1* 1/2011 Asakawa ..... H03H 7/0107 361/111

(Continued)

FOREIGN PATENT DOCUMENTS

JP S59-175108 A 10/1984
JP H05-044201 A 7/1993

(Continued)

OTHER PUBLICATIONS

An Office Action; "Notification of Reasons for Refusal," Mailed by the Japanese Patent Office dated Jun. 5, 2018, which corresponds to Japanese Patent Application No. 2015-217022 and is related to U.S. Appl. No. 15/283,736; with English language translation.

*Primary Examiner* — Mang Tin Bik Lian
(74) *Attorney, Agent, or Firm* — Studebaker & Brackett PC

(57) ABSTRACT

A coil component has a first surface and a second surface facing each other. The coil component has a coil conductor formed into a spiral shape and having a central axis intersecting with the first surface and the second surface, an insulation resin body covering the coil conductor and including an inner diameter hole part corresponding to the central axis of the coil conductor and a magnetic resin body disposed on the first surface side of the insulation resin body without being disposed on the second surface side of the insulation resin body. The magnetic resin body is also disposed inside the inner diameter hole part of the insulation resin body.

13 Claims, 25 Drawing Sheets

(56) References Cited

U.S. PATENT DOCUMENTS

| | | | | |
|---|---|---|---|---|
| 2011/0025442 | A1* | 2/2011 | Hsieh | H01F 17/0013 336/200 |
| 2011/0074537 | A1* | 3/2011 | Nakatsuji | H01F 17/0013 336/200 |
| 2014/0266547 | A1* | 9/2014 | Watanabe | H01F 17/0013 336/200 |

FOREIGN PATENT DOCUMENTS

| | | | |
|---|---|---|---|
| JP | H09-74037 | A | 3/1997 |
| JP | 2004-296860 | A | 10/2004 |
| JP | 2006-351819 | A | 12/2006 |
| JP | 2011-071457 | A | 4/2011 |
| JP | 2014-013815 | A | 1/2014 |
| JP | 2014-036223 | A | 2/2014 |

* cited by examiner

COIL COMPONENT

CROSS REFERENCE TO RELATED APPLICATIONS

This application claims benefit of priority to Japanese Patent Application 2015-217022 filed Nov. 4, 2015, the entire content of which is incorporated herein by reference.

TECHNICAL FIELD

The present disclosure relates to a coil component.

BACKGROUND

Conventional coil components include a coil described in Japanese Examined Patent Application Publication No. H5-44201. This coil component has a magnetic layer, a coil disposed on the magnetic layer, and an insulation layer disposed on the magnetic layer to cover the coil.

SUMMARY

Problem to be Solved by the Disclosure

It was found out that the following problem exists when the conventional coil component is actually manufactured and used. The coil component warps due to a difference in thermal expansion coefficient of the magnetic layer and the insulation layer. As a result, when the coil component is mounted on a mounting board, the reliability of mounting is impaired.

Therefore, a problem to be solved by the present disclosure is to provide a coil component capable of reducing the warpage to improve the reliability of mounting.

Solutions to the Problems

To solve the problem, a coil component of the present disclosure is a coil component having a first surface and a second surface facing each other, comprising:

a coil conductor formed into a spiral shape and having a central axis intersecting with the first surface and the second surface;

an insulation resin body covering the coil conductor and including an inner diameter hole part corresponding to the central axis of the coil conductor; and a magnetic resin body disposed on the first surface side of the insulation resin body without being disposed on the second surface side of the insulation resin body; wherein the magnetic resin body is also disposed inside the inner diameter hole part of the insulation resin body.

According to the coil component of the present disclosure, the magnetic resin body is disposed on the first surface side of the insulation resin body and is not disposed on the second surface side of the insulation resin body. As a result, the coil component warps due to a difference in thermal expansion coefficient of the magnetic resin body on the first surface side and the insulation resin body on the second surface side. However, since the magnetic resin body is also disposed inside the inner diameter hole part of the insulation resin body, the occurrence of the warpage is suppressed in the portion of the inner diameter hole part of the insulation resin body in the coil component and, consequently, the warpage of the whole of the coil component can be reduced.

In an embodiment of the coil component, the magnetic resin body entirely covers the first surface side of the insulation resin body.

According to the embodiment, since the magnetic resin body entirely covers the first surface side of the insulation resin body, the magnetic resin body can suppress the magnetic flux leakage from the first surface of the coil component.

In an embodiment of the coil component, the first surface is a mounting surface that is a side mounted on a mounting board, and the second surface is a detecting surface that is a side facing a detected conductor.

According to the embodiment, since the first surface is the mounting surface, the magnetic resin body is disposed on the mounting surface side of the coil conductor. As a result, the magnetic resin body can suppress a magnetic flux leakage from the mounting surface of the coil component. Therefore, when the mounting surface of the coil component is mounted on the mounting board, the magnetic flux leakage to the mounting board side of the coil component can be suppressed to acquire a desired inductance. Additionally, by suppressing the magnetic flux leakage to the mounting board side of the coil component, the magnetic coupling to wiring and another electronic component disposed on the mounting board can be suppressed to acquire a desired resonance operation. As a result, wiring and an electronic component can be arranged in the vicinity of the coil component so as to achieve a reduction in size of the mounting board on which the coil component is mounted.

On the other hand, since the second surface is the detecting surface, the magnetic resin body is not disposed on the detecting surface side of the coil conductor. As a result, the magnetic resin body does not interfere with the generation of the magnetic field from the detecting surface of the coil component. Therefore, when the detecting surface of the coil component is allowed to face a detected conductor, the magnetic resin body does not interfere with the generation of the magnetic field to the detected conductor side of the coil component and does not reduce the sensitivity of detection of the detected conductor by using the coil component.

In an embodiment of the coil component, the insulation resin body has a lower magnetic permeability and a higher thermal expansion coefficient than the magnetic resin body.

According to the embodiment, since the insulation resin body has a lower magnetic permeability and a higher thermal expansion coefficient than the magnetic resin body, usual materials can be used for the insulation resin body and the magnetic resin body.

In an embodiment of the coil component, the thermal expansion coefficient of the coil conductor is larger than the thermal expansion coefficient of the magnetic resin body and smaller than the thermal expansion coefficient of the insulation resin body.

According to the embodiment, since the thermal expansion coefficient of the coil conductor is larger than the thermal expansion coefficient of the magnetic resin body and smaller than the thermal expansion coefficient of the insulation resin body, usual materials can be used for the coil conductor, the insulation resin body, and the magnetic resin body.

In an embodiment of the coil component, the insulation resin body has an outer shape that is a quadrangular shape having one side direction and another side direction when viewed in the central axis direction, and wherein in at least one of the one side direction and the other side direction, the maximum length of the magnetic resin body in the inner diameter hole part is equal to or greater than one third of the maximum length of the insulation resin body.

According to the embodiment, since the maximum length of the magnetic resin body in the inner diameter hole part is equal to or greater than one third of the maximum length of the insulation resin body, a proportion of the magnetic resin body in the inner diameter hole part can be increased in the entire length along the direction to further reduce the warpage of the whole of the coil component.

In an embodiment of the coil component, the one side direction or the other side direction is a longitudinal direction, and in the longitudinal direction, the maximum length of the magnetic resin body in the inner diameter hole part is equal to or greater than one third of the maximum length of the insulation resin body.

According to the embodiment, since the maximum length of the magnetic resin body in the inner diameter hole part is equal to or greater than one third of the maximum length of the insulation resin body in the longitudinal direction, the length of the magnetic resin body in the inner diameter hole part can be ensured in the longitudinal direction in which a warpage tends to become larger, and the warpage can further be reduced.

In an embodiment of the coil component, the insulation resin body has an outer shape that is a quadrangular shape having one side direction and another side direction when viewed in the central axis direction, and wherein in at least one of the one side direction and the other side direction, the minimum distance between an outer surface of the insulation resin body and an outer surface of the coil conductor is 25 μm or more and 900 μm or less.

The outer surface of the coil conductor refers only to an outer side surface of an outermost circumference of the spiral of the coil conductor.

According to the embodiment, since the minimum distance between the outer surface of the insulation resin body and the outer surface of the coil conductor is 25 μm or more and 900 μm or less, a proportion of the coil conductor can be increased in the outer circumference side of the inner diameter hole part in which the warpage comparatively easily occurs, so as to reduce the warpage of the coil component, and the coil conductor can be prevented from being exposed from the insulation resin body due to dicing.

In an embodiment of the coil component, an external terminal connected to the coil conductor is disposed on the first surface side of the magnetic resin body, and the external terminal partially overlaps with a portion of the coil conductor when viewed in the central axis direction.

According to the embodiment, since the external terminal partially overlaps with a portion of the coil conductor when viewed in the central axis direction, a proportion of the coil conductor to a certain outer shape dimension of the coil component can be increased to reduce the warpage of the coil component. Since the external terminal can be made larger, the reliability of mounting can be increased.

In an embodiment of the coil component, a warpage prevention film is disposed on the second surface side of the insulation resin body, and a difference in thermal expansion coefficient of the warpage prevention film and the magnetic resin body is smaller than a difference in thermal expansion coefficient of the magnetic resin body and the insulation resin body.

According to the embodiment, since a difference in thermal expansion coefficient of the warpage prevention film and the magnetic resin body is smaller than a difference in thermal expansion coefficient of the magnetic resin body and the insulation resin body, the insulation resin body can be interposed between the warpage prevention film and the magnetic resin body having the small difference in thermal expansion coefficient and the warpage of the whole of the coil component can further be reduced.

In an embodiment of the coil component, the warpage prevention film has a magnetic permeability lower than the magnetic resin body.

According to the embodiment, since the warpage prevention film has a magnetic permeability lower than the magnetic resin body, the warpage prevention film does not interfere with the generation of the magnetic field from the second surface of the coil component.

In an embodiment of the coil component, the warpage prevention film contains a glass filler.

According to the embodiment, since the warpage prevention film contains a glass filler, the thermal expansion coefficient of the warpage prevention film can be made smaller than the thermal expansion coefficient of the insulation resin body, and the magnetic permeability of the warpage prevention film can be made smaller than the magnetic permeability of the magnetic resin body.

In an embodiment of the coil component, the magnetic resin body penetrates the insulation resin body to the second surface side and contacts with the warpage prevention film.

According to the embodiment, since the magnetic resin body penetrates the insulation resin body to the second surface side and contacts with the warpage prevention film, the coil component can be reduced in height.

In an embodiment of the coil component, the coil conductor contacts with the warpage prevention film.

According to the embodiment, since the coil conductor contacts with the warpage prevention film, the coil component can further be reduced in height.

In an embodiment of the coil component, the magnetic resin body penetrates the insulation resin body and the warpage prevention film to the second surface side.

According to the embodiment, since the magnetic resin body penetrates the insulation resin body and the warpage prevention film to the second surface side, the warpage prevention film does not interfere with the generation of the magnetic field from the second surface of the coil component. This leads to an increase in degree of freedom of material selection of the warpage prevention film.

In an embodiment of the coil component, the warpage prevention film has an opening part overlapping with the magnetic resin body in the inner diameter hole part when viewed in the central axis direction.

According to the embodiment, since the warpage prevention film has an opening part overlapping with the magnetic resin body in the inner diameter hole part when viewed in the central axis direction, the warpage prevention film does not interfere with the generation of the magnetic field from the second surface of the coil component regardless of the magnetic permeability of the warpage prevention film.

In an embodiment of the coil component, a magnetic material is disposed in the opening part of the warpage prevention film.

According to the embodiment, since a magnetic material is disposed in the opening part of the warpage prevention film, the L-value and the Q-value can be increased without making the warpage of the coil component larger. Additionally, entry of water etc. can be suppressed to improve the reliability of the coil component.

Effect of the Disclosure

According to the coil component of the present disclosure, since the magnetic resin body is disposed inside the inner diameter hole part of the insulation resin body, the warpage can be reduced to improve the reliability of mounting.

DETAILED DESCRIPTION

The present disclosure will now be described in detail with the shown embodiments.

First Embodiment

Figure 1A:
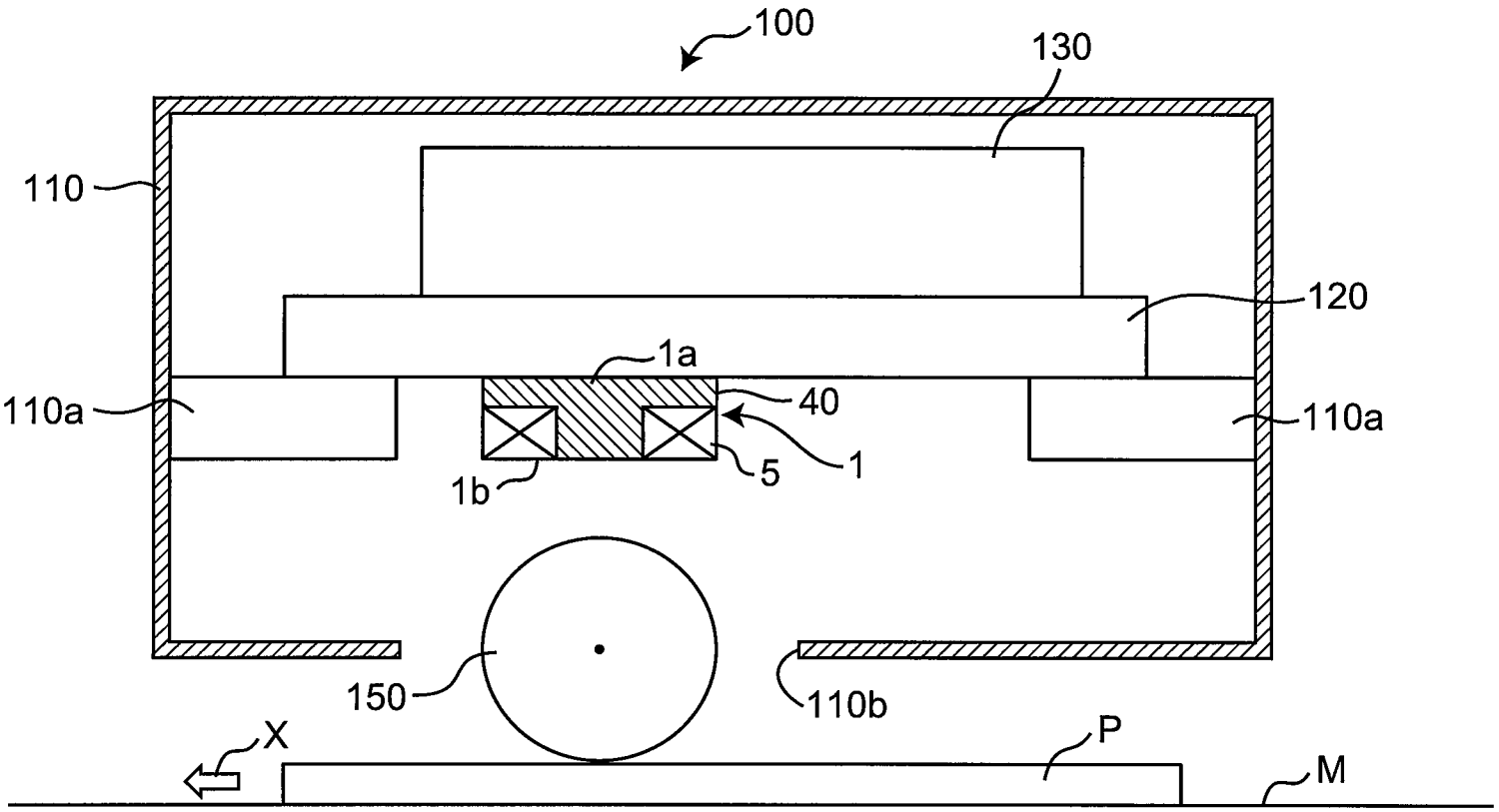
FIG. 1A is a simplified configuration diagram of a first embodiment of a thickness detection apparatus including a coil component of the present disclosure.

FIG. 1A is a simplified configuration diagram of a first embodiment of a thickness detection apparatus including a coil component of the present disclosure. As shown in FIG. 1A, a thickness detection apparatus 100 is incorporated into an ATM (automatic teller machine), for example, and detects thickness of paper money. The thickness detection apparatus 100 is disposed above a conveyance path M to detect a thickness of a paper sheet P conveyed in an X direction of the conveyance path M.

The thickness detection apparatus 100 has a casing 110 as well as a mounting board 120, a coil component 1, and a thickness detection circuit 130 disposed in the casing 110, and a roller 150 disposed in an opening part 110*b* on the conveyance path M side of the casing 110.

The mounting board 120 is attached via an attaching part 110*a* to the inside of the casing 110. The coil component 1 is attached to a surface of the mounting board 120 on the conveyance path M side. The thickness detection circuit 130 is attached to a surface of the mounting board 120 on the side opposite to the conveyance path M. The roller 150 is attached to the casing 110 such that the roller 150 freely rotates and freely advances and retracts from the opening part 110*b*. The roller 150 is disposed to face the coil component 1 and freely moves close to and away from the coil component 1.

The roller 150 is rotated while being in contact with the paper sheet P and is displaced in a direction of the coil component 1 depending on the thickness of the paper sheet P. Therefore, the roller 150 detects the thickness of the paper sheet P as a displacement amount. A high frequency signal is applied to the coil component 1 to generate a high-frequency magnetic field. The roller 150 is made of a conductor and generates an eddy current due to the magnetic field generated from the coil component 1.

Figure 1B:
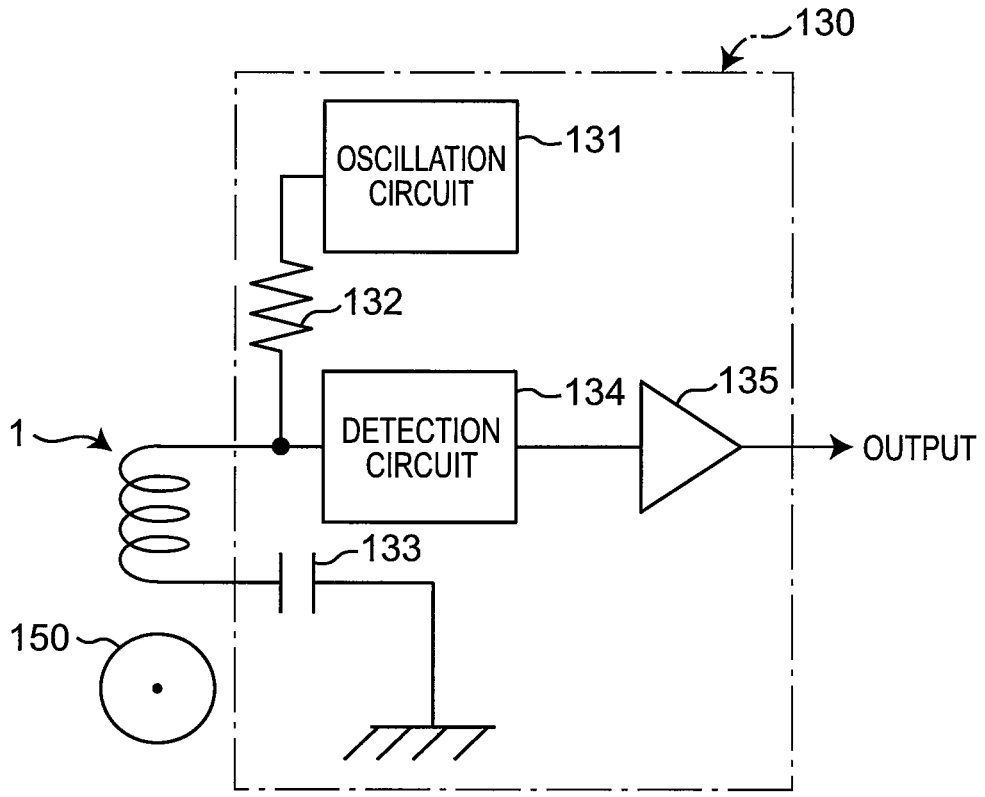
FIG. 1B is a circuit diagram of a thickness detection circuit.

As shown in FIG. 1B, the thickness detection circuit 130 is a circuit electrically detecting the thickness of the paper sheet P and is made up of an oscillation circuit 131, a resistor 132, a capacitor 133, a detection circuit 134, and an amplification circuit 135. The oscillation circuit 131 outputs a high frequency signal through the resistor 132. One end of the coil component 1 (coil conductor) is connected through the resistor 132 to the oscillation circuit 131 and the other end of the coil component 1 (coil conductor) is grounded through the capacitor 133.

The detection circuit 134 is a circuit extracting a direct current signal corresponding to the amplitude of the high frequency signal from the oscillation circuit 131. This direct current signal is a signal proportional to a distance between the roller 150 described later and the coil component 1 (the thickness of the paper sheet P). The amplification circuit 135 amplifies a direct current signal input by the detection circuit 134. An output signal of the amplification circuit 135 corresponds to the thickness of the paper sheet P as a thickness detection result.

An operation of the thickness detection apparatus 100 will be described.

When the oscillation circuit 131 is driven, the oscillation circuit 131 supplies a high frequency signal through the resistor 132 to the coil component 1. As a result, a high-frequency current is applied to the coil component 1 and a high-frequency magnetic field is generated around the coil component 1.

When the paper sheet P is conveyed in the X direction in such a state, the roller 150 is rotated while being in contact with a surface of the paper sheet P, and is displaced in the direction of the coil component 1 depending on a thickness of the paper sheet P.

When the roller 150 is displaced in the direction toward the coil component 1, an eddy-current loss associated with the high-frequency magnetic field from the coil component 1 becomes larger and the amplitude of the high frequency signal from the oscillation circuit 131 therefore becomes smaller.

On the other hand, when the roller 150 is displaced in the direction away from the coil component 1, an eddy-current loss associated with the high-frequency magnetic field from the coil component 1 becomes smaller and the amplitude of the high frequency signal from the oscillation circuit 131 therefore becomes larger.

As described above, the distance between roller 150 and the coil component 1 is proportional to the amplitude of the high frequency signal from the oscillation circuit 131. Therefore, since the distance between the roller 150 and the coil component 1 is proportional to the thickness of the paper sheet P, the amplitude of the high frequency signal from the oscillation circuit 131 is proportional to the thickness of the paper sheet P.

The high frequency signal from the oscillation circuit 131 is detected by the detection circuit 134. Thus, the detection circuit 134 outputs a direct current signal corresponding to the amplitude of the high frequency signal to the amplification circuit 135. As a result, the direct current signal is amplified by the amplification circuit 135. The output signal of the amplification circuit 135 is a signal corresponding to the thickness of the paper sheet P. In this way, the thickness detection apparatus 100 outputs the thickness of the paper sheet P as the signal from the amplification circuit 135.

Figure 2:
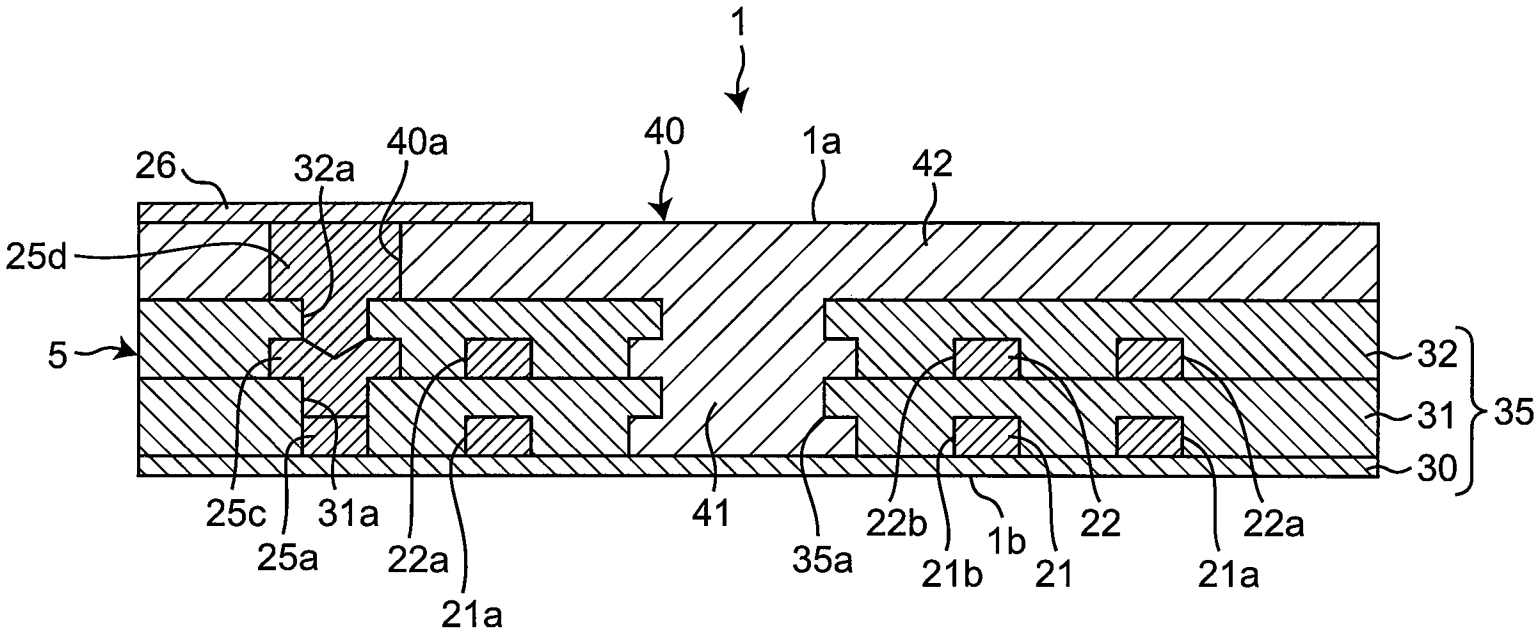
FIG. 2 is a cross-sectional view of a first embodiment of the coil component.

FIG. 2 is a cross-sectional view of a first embodiment of the coil component 1. As shown in FIGS. 1A and 2, the coil component 1 includes a first surface 1*a* and a second surface 1*b* facing each other. The first surface 1*a* is a mounting surface that is a side mounted on the mounting board 120. The second surface 1*b* is a detecting surface that is a side facing the roller 150 (an example of a detected conductor) and generates a magnetic field toward the roller 150.

The coil component 1 has a coil substrate 5 and a magnetic resin body 40 partially covering the coil substrate 5. The coil substrate 5 has two layers of coil conductors 21, 22 and an insulation resin body 35 covering the two layers of the coil conductors 21, 22.

The first and second coil conductors 21, 22 are arranged in order from a lower layer to an upper layer. The first and second coil conductors 21, 22 are each formed into a plane spiral shape. The first and second coil conductors 21, 22 are made of low-resistance metal, for example, Cu, Ag, or Au. Preferably, low-resistance and narrow-pitch coil conductors can be formed by using Cu plating formed by a semi-additive process.

Figure 3A:
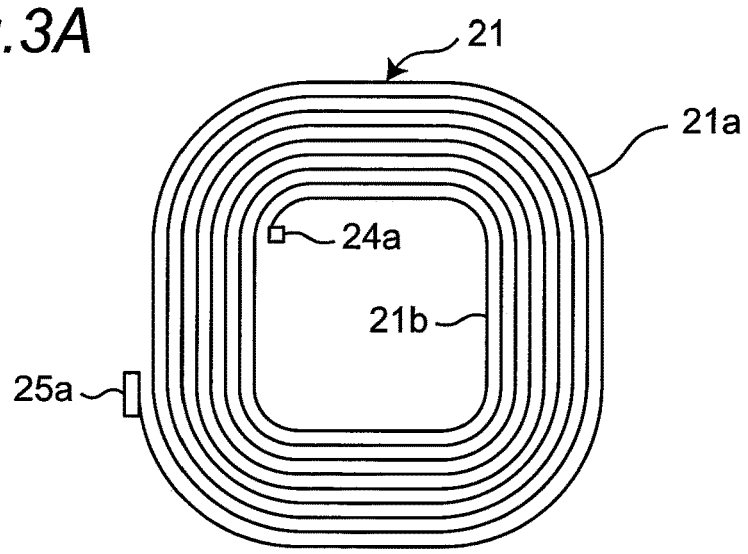
FIG. 3A is a plane view of a first coil conductor.
Figure 3B:
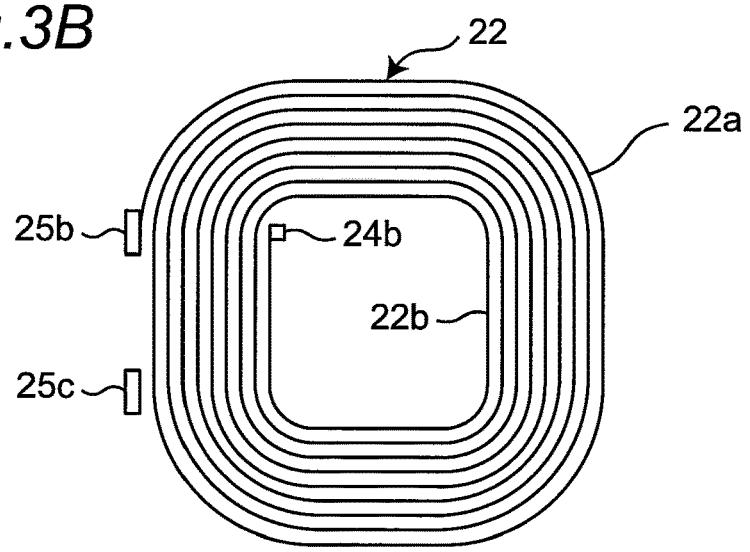
FIG. 3B is a plane view of a second coil conductor.

As shown in FIG. 3A, the first coil conductor 21 has a plane spiral shape clockwise from the outer circumference toward the inner circumference. As shown in FIG. 3B, the second coil conductor 22 has a plane spiral shape clockwise from the inner circumference toward the outer circumference. In FIG. 2, the numbers of turns of the coil conductors 21, 22 are reduced as compared to FIGS. 3A and 3B for easy understanding.

Figure 3C:
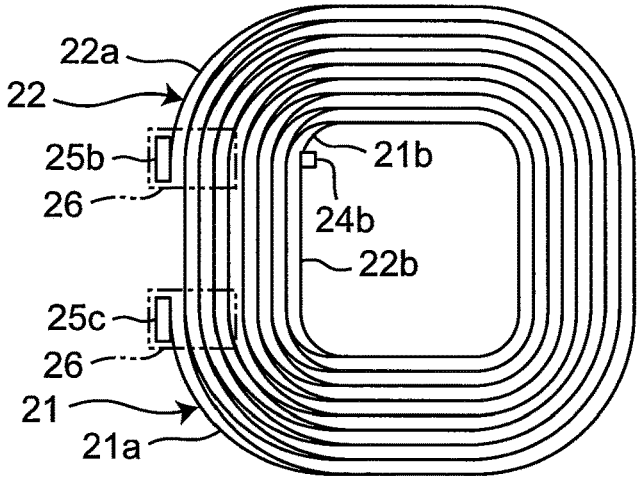
FIG. 3C is a plane view of the first and second coil conductors.

An inner circumferential end of the first coil conductor 21 is connected to an inner circumferential connection wiring 24*a*. An inner circumferential end of the second coil conductor 22 is connected to the inner circumferential connection wiring 24*b*. As shown in FIG. 3C, the respective inner circumferential connection wirings 24*a*, 24*b* are electrically connected through connection via (not shown) to each other.

An outer circumferential end of the first coil conductor 21 is connected to an outer circumferential connection wiring 25*a*. An outer circumferential end of the second coil conductor 22 is connected to an outer circumferential connection wiring 25*b*. The outer circumferential connection wiring 25*a* connected to the outer circumferential end of the first coil conductor 21 is connected to one external terminal 26 through an outer circumferential connection wiring 25*c* (FIG. 3B) disposed on the same layer as the second coil conductor 22 without connection to the second coil conductor 22 and an outer circumferential connection wiring 25*d* on an upper layer of this outer circumferential connection wiring 25*c*. Similarly, the outer circumferential connection wiring 25*b* connected to the outer circumferential end of the second coil conductor 22 is connected to the other external terminal 26 through an outer circumferential connection wiring (not shown) on an upper layer of the outer circumferential connection wiring 25*b*.

The central axes of the first and second coil conductors 21, 22 are concentrically arranged to intersect with the first surface 1*a* and the second surface 1*b*. In this embodiment, the central axes of the first and second coil conductors 21, 22 are orthogonal to the first surface 1*a* and the second surface 1*b*.

The insulation resin body 35 has a base insulation resin and first and second insulation resins 31, 32. The base insulation resin 30 and the first and second insulation resins 31, 32 are arranged in order from a lower layer to an upper layer. The material of the insulation resins 30 to 32 is, for example, a single material that is an organic insulation material made of epoxy-based resin, bismaleimide, liquid crystal polymer, polyimide, etc., or is an insulation material comprising a combination of these organic insulation material and an inorganic filler material such as a silica filler or an organic filler made of a rubber material. Preferably, all the insulation resins 30 to 32 are made of the same material. In this embodiment, all the insulation resins 30 to 32 are made of an epoxy resin containing a silica filler.

The first coil conductor 21 is laminated on the base insulation resin 30. The first insulation resin 31 is laminated on the first coil conductor 21 to cover the first coil conductor 21. The second coil conductor 22 is laminated on the first insulation resin 31. The second insulation resin 32 is laminated on the second coil conductor 22 to cover the second coil conductor 22. The second coil conductor 22 is connected to the first coil conductor 21 through a via hole (not shown) disposed in the first insulation resin 31.

Outer surfaces 21*a*, 22*a* and inner surfaces 21*b*, 22*b* of the first and second coil conductors 21, 22 are covered with the insulation resin body 35. The insulation resin body 35 has an inner diameter hole part 35*a* corresponding to the central axes of the first and second coil conductors 21, 22. The inner diameter hole part 35*a* is made up of hole parts of the first and second insulation resins 31, 32. The outer surfaces 21*a*, 22*a* refer only to outer side surfaces of outermost circumferences of spirals. Therefore, the outer surfaces 21*a*, 22*a* do not include upper surfaces, lower surfaces, and outer side surfaces of inner circumferential turn parts. Additionally, the outer surfaces 21*a*, 22*a* do not include the outer surfaces of the outer circumferential connection wirings 25*a* to 25*d* that are not the coil conductors.

The magnetic resin body 40 is disposed on the first surface 1*a* side of the first and second coil conductors 21, 22 without being disposed on the second surface 1*b* side of the first and second coil conductors 21, 22. The magnetic resin body 40 is disposed on the inside (in the inner diameter hole part 35*a*) of the inner surfaces 21*b*, 22*b* of the first and second coil conductors 21, 22.

Therefore, the magnetic resin body 40 has an inner portion 41 disposed in the inner diameter hole part 35*a* of the insulation resin body 35 and an end part 42 disposed on an end surface of the insulation resin body 35 on the first surface 1*a* side. The inner portion 41 makes up an inner magnetic path of the coil component 1 and the end part 42 makes up an outer magnetic path of the coil component 1. The end part 42 entirely covers the first surface 1*a* side of the insulation resin body 35. The end part 42 covers the first and second coil conductors 21, 22 when viewed from the first surface 1*a* side in the axial direction of the first and second coil conductors 21, 22, and is disposed from the outer side of the outer surfaces 21*a*, 22*a* of the first and second coil conductors 21, 22 onto the inner portion 41.

The material of the magnetic resin body 40 is, for example, a resin material containing magnetic powder. The magnetic powder is, for example, a metal magnetic material such as Fe, Si, and Cr and the resin material is, for example, a resin material such as epoxy. For improvement of the characteristics of the coil component 1 (L-value and superposition characteristics), it is desirable to contain the magnetic powder at 90 wt % or more and, for improvement of a filling property of the magnetic resin body 40, it is more desirable to mix two or three types of magnetic powder different in particle size distribution.

On the first surface 1*a* side of the magnetic resin body 40, the two external terminals 26 are disposed that are to be connected to terminals of the mounting board 120. One of the external terminals 26 is connected through the outer circumferential connection wirings 25*a*, 25*c*, 25*d* described above to the first coil conductor 21. The other external terminal 26 is connected through the outer circumferential connection wiring 25*b* described above to the second coil conductor 22. Portions of the external terminals 26 partially overlap with the first and second coil conductors 21, 22 when viewed in the central axis direction of the first and second coil conductors 21, 22.

The external terminals 26 are made of a mixed material of resin and metal. The metal is made of, for example, Ag, Cu, and Au having small resistivity. The resin is made of, for example, phenol resin having a small Young's modulus. Surfaces of the external terminals 26 may be coated with Ni/Sn plating etc., so as to ensure wettability with solder.

The insulation resin body 35 has a lower magnetic permeability and a higher thermal expansion coefficient than the magnetic resin body 40. The thermal expansion coefficient of the first and second coil conductors 21, 22 is larger than the thermal expansion coefficient of the magnetic resin body 40 and smaller than the thermal expansion coefficient of the insulation resin body 35. For example, in the case of typical materials listed above, the thermal expansion coefficient of the insulation resin body 35 is 30 to 50 ppm/K; the thermal expansion coefficient of the magnetic resin body 40 is 0 to 15 ppm/K; and the thermal expansion coefficient of the first and second coil conductors 21, 22 is 16 ppm/K. Therefore, usual materials can be used for the first and second coil conductors 21, 22, the insulation resin body 35, and the magnetic resin body 40.

Figure 4A:
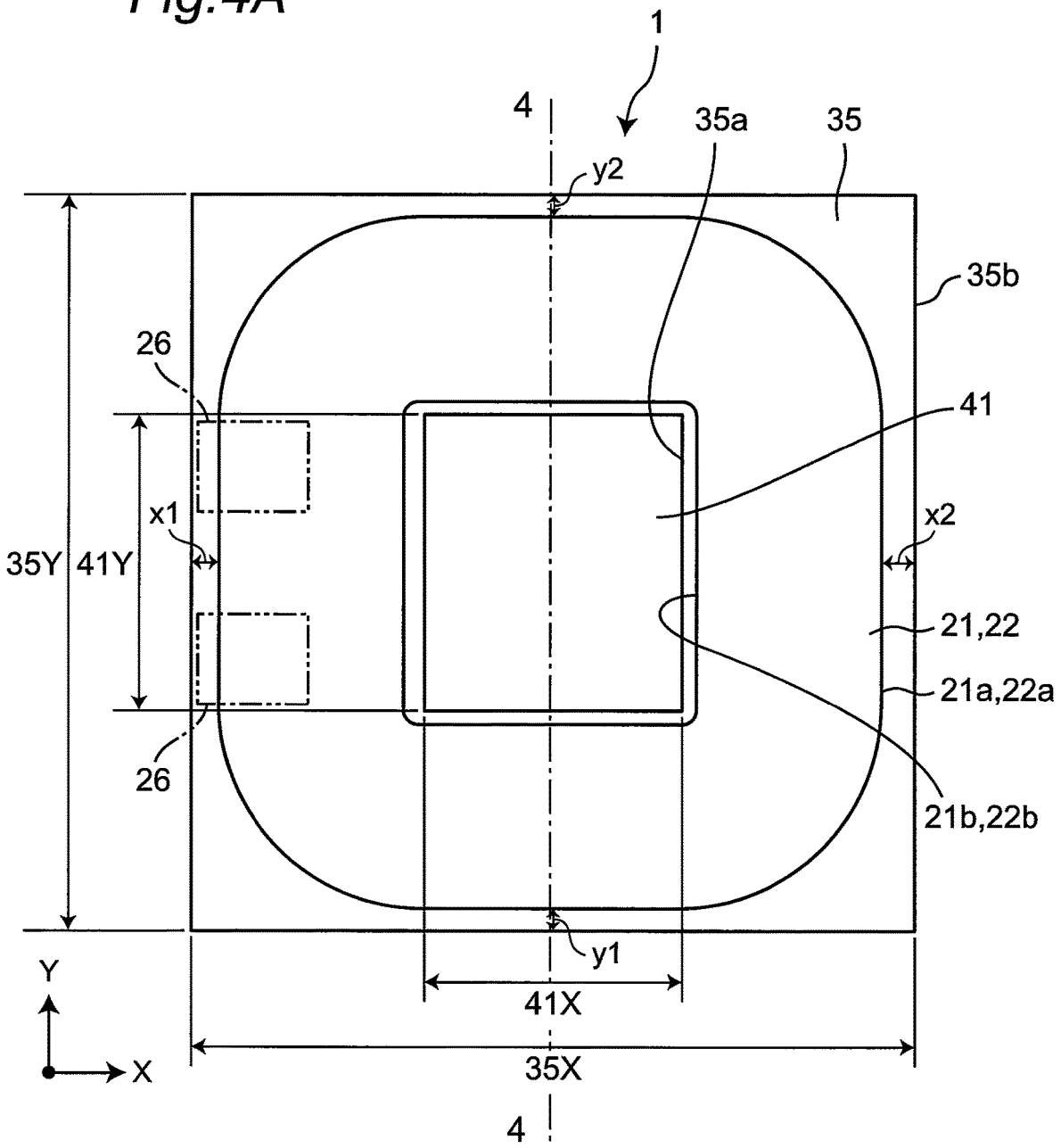
FIG. 4A is a simplified plane view of the coil component.
Figure 4B:
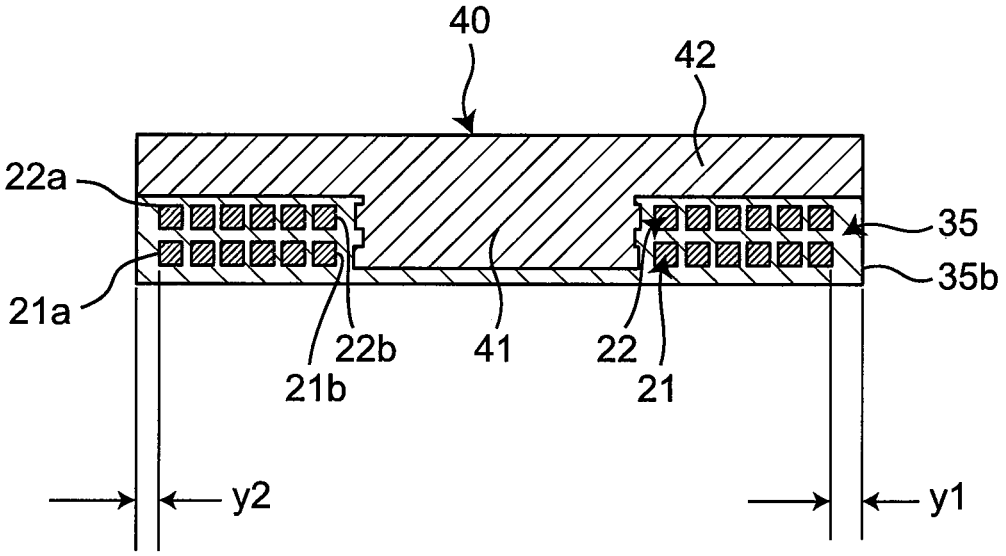
FIG. 4B is a cross-sectional view taken along 4-4 of FIG. 4A.

FIG. 4A is a schematic cross-sectional view of the coil component 1. FIG. 4B is a cross-sectional view taken along 4-4 of FIG. 4A. As shown in FIGS. 4A and 4B, the insulation resin body 35 has an outer shape that is a quadrangular shape having one side direction (X direction) and another side direction (Y direction) when viewed in the central axis direction of the first coil conductor 21. Although the outer shape of the magnetic resin body 40 in the inner diameter hole part 35*a* (i.e., the inner portion 41) is also a quadrangular shape, the shape may be a circular shape or an elliptic shape. FIG. 4A schematically shows the outermost surface of the first coil conductor 21 and the second coil conductor 22 (outer one of the outer surface 21*a* and the outer surface 22*a*). It is noted that the outermost surface may not actually have a substantially quadrangular shape as in FIG. 4A due to the positions of the outer circumferential connection wirings 25*a* to 25*d* and the ends of the coil conductors 21, 22.

In the X direction, a maximum length 41X of the inner portion 41 of the magnetic resin body 40 is equal to or greater than one third of a maximum length 35X of the insulation resin body 35. In the Y direction, a maximum length 41Y of the inner portion 41 of the magnetic resin body 40 is equal to or greater than one third of a maximum length 35Y of the insulation resin body 35. The condition of the maximum length may be satisfied in either the X direction or the Y direction. Particularly, the condition of the maximum length is preferably satisfied in the longitudinal direction out of the X direction and the Y direction. When the condition of the maximum length is satisfied in the longitudinal direction in which a warpage tends to become larger, the warpage can more effectively be reduced.

In the X direction, a minimum distance x1 between a left outer surface 35*b* of the insulation resin body 35 and a left outer surface 21*a* of the first coil conductor 21 and a minimum distance x2 between a right outer surface 35*b* of the insulation resin body 35 and a right outer surface 21*a* of the first coil conductor 21 are both 25 μm or more and 900 μm or less. The left minimum distance x1 and the right minimum distance x2 may be the same or different.

In the Y direction, a minimum distance y1 between a lower outer surface 35*b* of the insulation resin body 35 and a lower outer surface 21*a* of the first coil conductor 21 and a minimum distance y2 between an upper outer surface 35*b* of the insulation resin body 35 and an upper outer surface 21*a* of the first coil conductor 21 are both 25 μm or more and 900 μm or less. The lower minimum distance y1 and the upper minimum distance y2 may be the same or different.

The condition of the minimum distance may be satisfied in either the X direction or the Y direction. The same applies to the minimum distance between the insulation resin body 35 and the second coil conductor 22. The conditions may be satisfied by the minimum distance between the outer surface 35*b* of the insulation resin body 35 and outer one (the outermost surface) of the outer surface 21*a* of the first coil conductor 21 and the outer surface 22*a* of the second coil conductor 22.

A method of manufacturing the coil component 1 will be described.

Figure 5A:
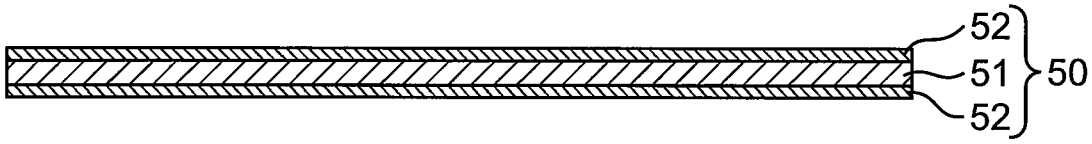
FIG. 5A is an explanatory view for explaining a first embodiment of a manufacturing method of the coil component of the present disclosure.

As shown in FIG. 5A, a base 50 is prepared. The base 50 has an insulation substrate 51 and base metal layers 52 disposed on both sides of the insulation substrate 51. In this embodiment, the insulation substrate 51 is a glass epoxy substrate and the base metal layers 52 are Cu foils.

Figure 5B:
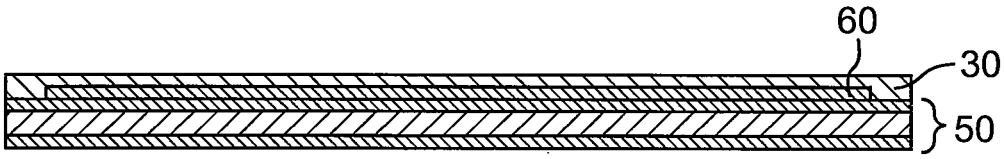
FIG. 5B is an explanatory view for explaining the first embodiment of the manufacturing method of the coil component of the present disclosure.

As shown in FIG. 5B, a dummy metal layer 60 is bonded onto a surface of the base 50. In this embodiment, the dummy metal layer 60 is a Cu foil. Since the dummy metal layer 60 is bonded to the base metal layer 52 of the base 50, the dummy metal layer 60 is bonded to a smooth surface of the base metal layer 52. Therefore, an adhesion force can be made weak between the dummy metal layer 60 and the base metal layer 52 and, at a subsequent step, the base 50 can easily be peeled from the dummy metal layer 60. Preferably, an adhesive bonding the base 50 and the dummy metal layer 60 is an adhesive with low tackiness. For weakening of the adhesion force between the base 50 and the dummy metal layer 60, it is desirable that the bonding surfaces of the base 50 and the dummy metal layer 60 are glossy surfaces.

Subsequently, the base insulation resin 30 is laminated on the dummy metal layer 60 temporarily bonded to the base 50. In this case, the base insulation resin 30 is laminated by a vacuum laminator and is then thermally cured.

Figure 5C:
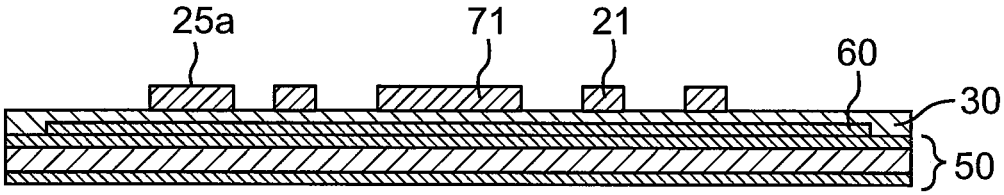
FIG. 5C is an explanatory view for explaining the first embodiment of the manufacturing method of the coil component of the present disclosure.

As shown in FIG. 5C, the first coil conductor 21, a first sacrificial conductor 71 corresponding to the inner magnetic path, and the outer circumferential connection wiring 25*a* are disposed on the base insulation resin 30. In this case, the first coil conductor 21, the first sacrificial conductor 71, and the outer circumferential connection wiring 25*a* are formed at the same time by the semi-additive process. The inner circumferential connection wirings 24*a*, 24*b* (see FIGS. 3A and 3B) are formed in the same way as the outer circumferential connection wiring 25*a*.

Figure 5D:
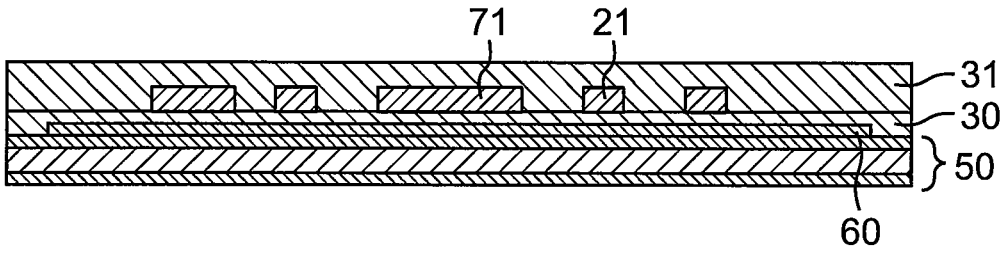
FIG. 5D is an explanatory view for explaining the first embodiment of the manufacturing method of the coil component of the present disclosure.

As shown in FIG. 5D, the first coil conductor 21 and the first sacrificial conductor 71 are covered with the first insulation resin 31. In this case, the first insulation resin 31 is laminated by a vacuum laminator and is then thermally cured.

Figure 5E:
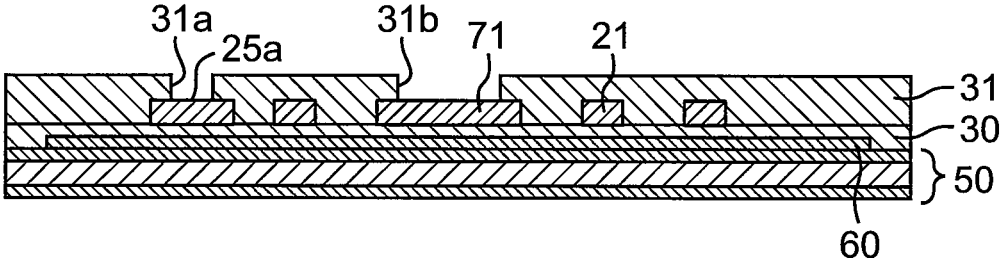
FIG. 5E is an explanatory view for explaining the first embodiment of the manufacturing method of the coil component of the present disclosure.

As shown in FIG. 5E, the via hole 31*a* is disposed in a portion of the first insulation resin 31 to expose the outer circumferential connection wiring 25*a*, and an opening part 31*b* is disposed in a portion of the first insulation resin 31 to expose the first sacrificial conductor 71. The via hole 31*a* and the opening part 31*b* are formed by laser machining.

Figure 5F:
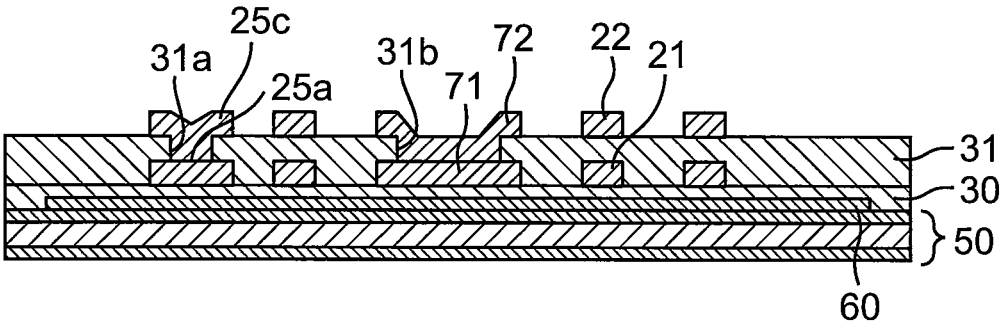
FIG. 5F is an explanatory view for explaining the first embodiment of the manufacturing method of the coil component of the present disclosure.

As shown in FIG. 5F, the second coil conductor 22 is disposed on the first insulation resin 31. The outer circumferential connection wiring 25*c* is disposed in the via hole 31*a* of the first insulation resin 31 and is connected to the outer circumferential connection wiring 25*a* on the same layer as the first coil conductor 21. A second sacrificial conductor 72 corresponding to the inner magnetic path is disposed on the first sacrificial conductor 71 in the opening part 31*b* of the first insulation resin 31.

Figure 5G:
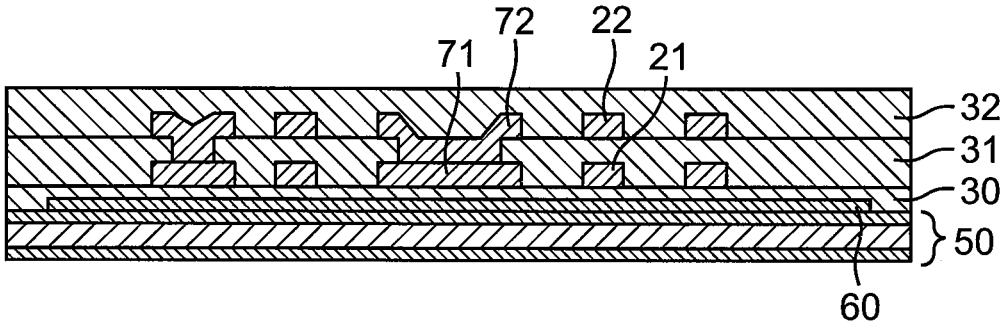
FIG. 5G is an explanatory view for explaining the first embodiment of the manufacturing method of the coil component of the present disclosure.

As shown in FIG. 5G, the second coil conductor 22 and the second sacrificial conductor 72 are covered with the second insulation resin 32.

Figure 5H:
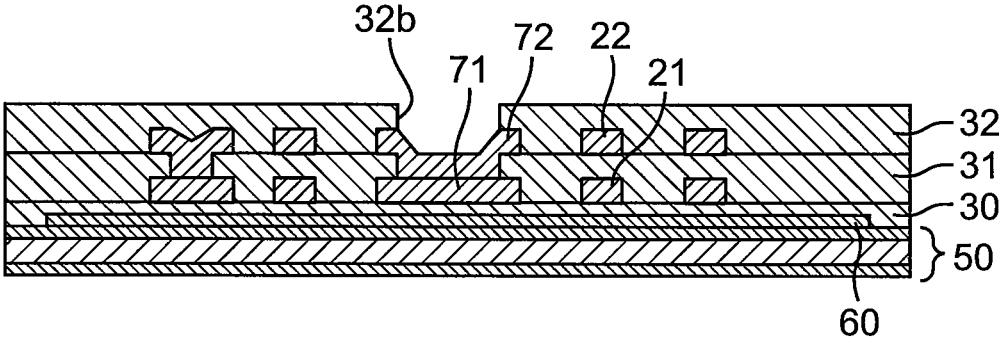
FIG. 5H is an explanatory view for explaining the first embodiment of the manufacturing method of the coil component of the present disclosure.

As shown in FIG. 5H, an opening part 32*b* is disposed in a portion of the second insulation resin 32 to expose the second sacrificial conductor 72.

Figure 5I:
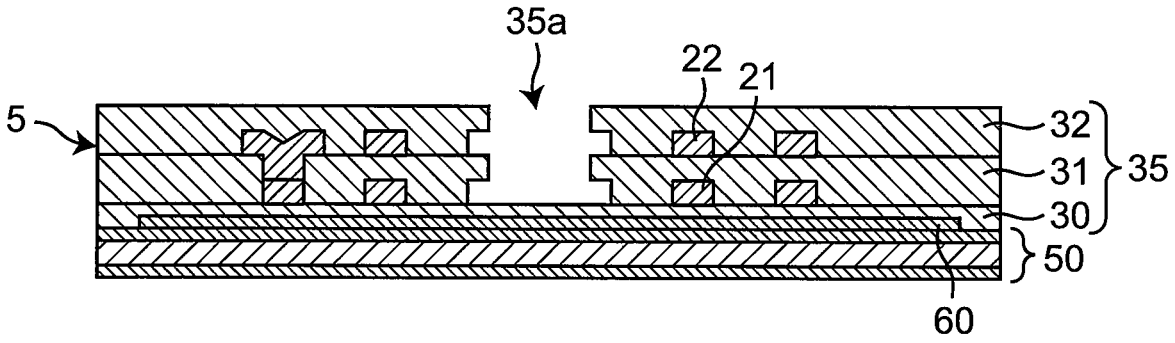
FIG. 5I is an explanatory view for explaining the first embodiment of the manufacturing method of the coil component of the present disclosure.

As shown in FIG. 5I, the first and second sacrificial conductors 71, 72 are removed and the inner diameter hole part 35*a* corresponding to the inner magnetic path is disposed in the insulation resin body 35 made up of the insulation resins 30 to 32. The first and second sacrificial conductors 71, 72 are removed by etching. The materials of the sacrificial conductors 71, 72 are, for example, the same material as the coil conductors 21, 22. In this way, the coil substrate 5 is formed of the coil conductors 21, 22 and the insulation resins 30 to 32.

Figure 5J:
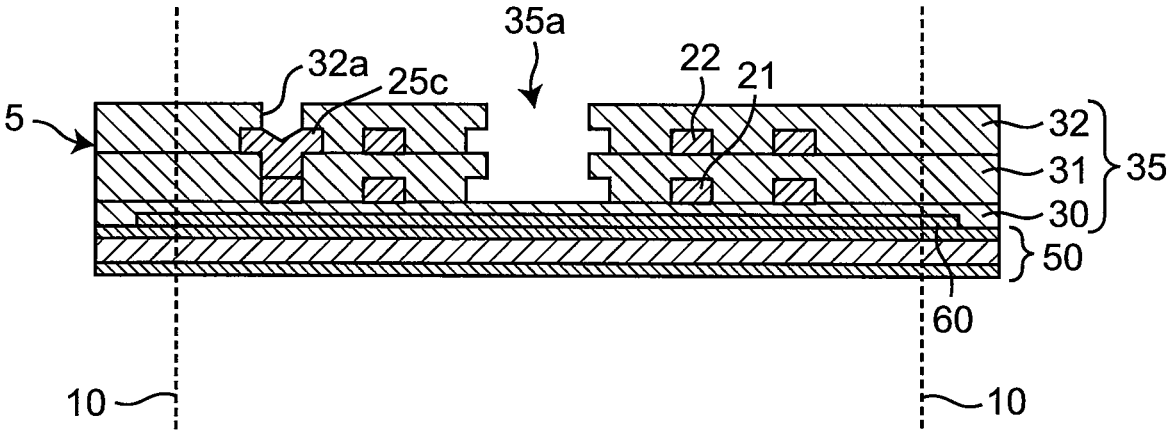
FIG. 5J is an explanatory view for explaining the first embodiment of the manufacturing method of the coil component of the present disclosure.

As shown in FIG. 5J, the via hole 32*a* is disposed in a portion of the second insulation resin 32 to expose the outer circumferential connection wiring 25*c* on the same layer as the second coil conductor 22. An end part of the coil substrate 5 is cut off along a cutline 10 together with an end part of the base 50. The cutline 10 is located on the inner side of an end surface of the dummy metal layer 60.

Figure 5K:
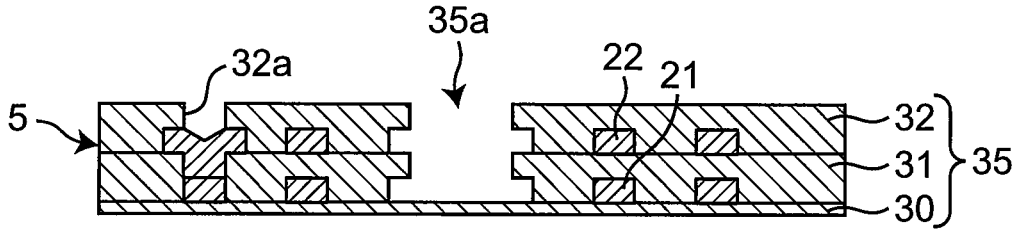
FIG. 5K is an explanatory view for explaining the first embodiment of the manufacturing method of the coil component of the present disclosure.

As shown in FIG. 5K, the base 50 is peeled off from the dummy metal layer 60 on the bonding plane between the surface of the base 50 (the base metal layer 52) and the dummy metal layer 60 and the dummy metal layer 60 is removed by etching.

Figure 5L:
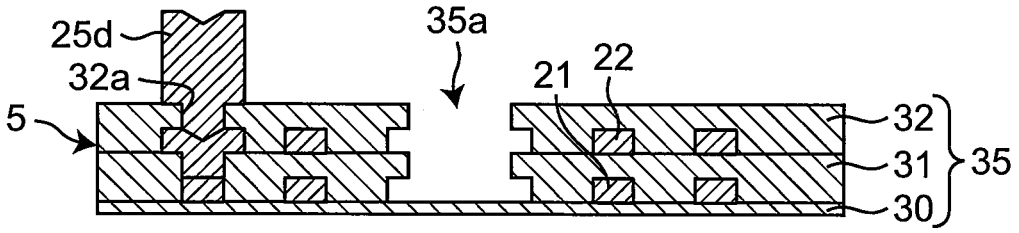
FIG. 5L is an explanatory view for explaining the first embodiment of the manufacturing method of the coil component of the present disclosure.

As shown in FIG. 5L, the outer circumferential connection wiring 25*d* is disposed in the via hole 32*a* of the second insulation resin 32 to connect the outer circumferential connection wiring 25*d* to the outer circumferential connection wiring 25*c* on the same layer as the second coil conductor 22. The outer circumferential connection wiring 25*d* is formed by the semi-additive process.

Figure 5M:
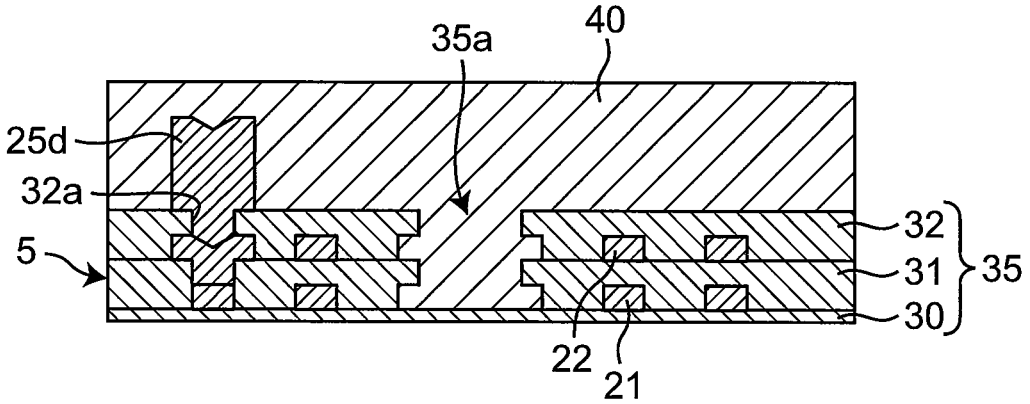
FIG. 5M is an explanatory view for explaining the first embodiment of the manufacturing method of the coil component of the present disclosure.

As shown in FIG. 5M, one surface of the coil substrate on the second insulation resin 32 side is covered with the magnetic resin body 40. In this case, a plurality of sheets of the shaped magnetic resin body 40 is disposed on one side of the coil substrate 5 in the lamination direction, is heated and press-bonded by a vacuum laminator or a vacuum press machine, and is subsequently subjected to cure treatment. The magnetic resin body 40 is filled into the inner diameter hole part 35*a* of the insulation resin body 35 to make up the inner magnetic path and is disposed on one surface of the insulation resin body 35 to make up the outer magnetic path.

Figure 5N:
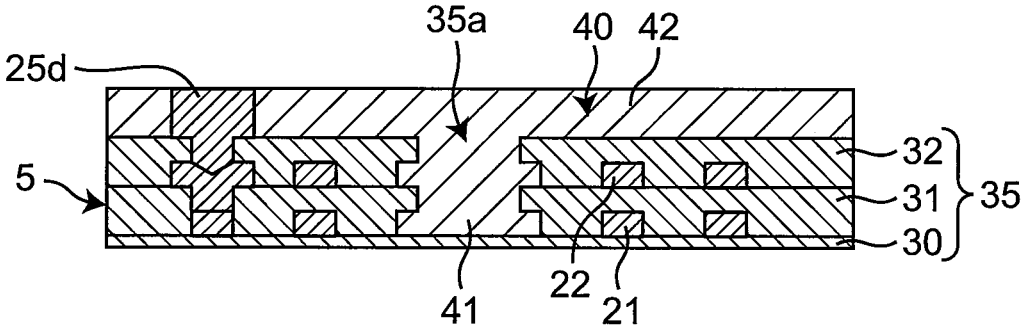
FIG. 5N is an explanatory view for explaining the first embodiment of the manufacturing method of the coil component of the present disclosure.

As shown in FIG. 5N, the magnetic resin body 40 is subjected to grinding by a back grinder etc. to adjust chip thickness. In this case, an upper part of the outer circumferential connection wiring 25*d* is exposed.

Figure 5O:
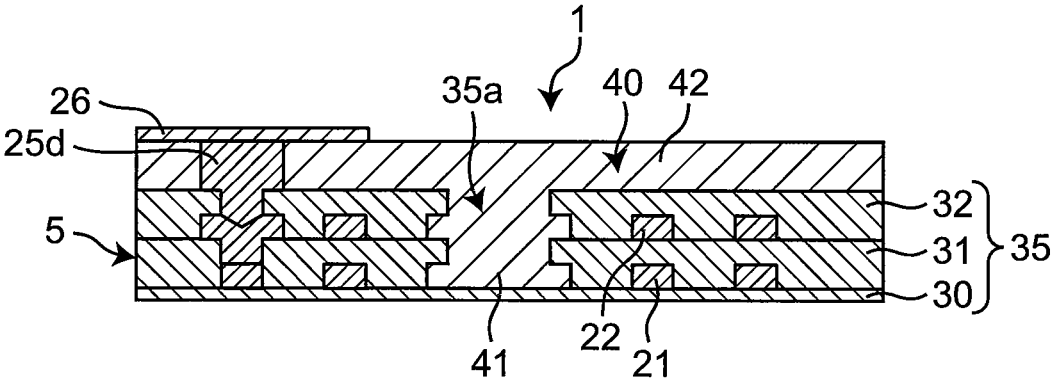
FIG. 5O is an explanatory view for explaining the first embodiment of the manufacturing method of the coil component of the present disclosure.

As shown in FIG. 5O, on one surface of the magnetic resin body 40, the external terminal 26 is disposed and connected to the outer circumferential connection wiring 25*d*. The external terminal 26 is formed by application of a resin electrode with dispersed metal microparticles by screen printing followed by dry-curing. Subsequently, after a dicer etc. are used for cutting into individual chips, a Ni/Sn plating coating film is formed on the external terminal 26 to acquire the coil component 1.

According to the coil component 1, the magnetic resin body 40 is disposed on the first surface 1*a* side of the insulation resin body 35 and is not disposed on the second surface 1*b* side of the insulation resin body 35. As a result, the coil component 1 warps due to a difference in thermal expansion coefficient of the magnetic resin body 40 on the first surface 1*a* side and the insulation resin body 35 on the second surface 1*b* side. However, since the magnetic resin body 40 is also disposed inside the inner diameter hole part 35*a* of the insulation resin body 35, the occurrence of the warpage is suppressed in the portion of the inner diameter hole part 35*a* of the insulation resin body 35 in the coil component 1 and, consequently, the warpage of the whole of the coil component 1 can be reduced.

According to the coil component 1, since the first surface 1*a* is the mounting surface, the magnetic resin body 40 is disposed on the mounting surface 1*a* side of the coil conductors 21, 22. As a result, the magnetic resin body 40 can suppress a magnetic flux leakage from the mounting surface of the coil component 1. Therefore, when the mounting surface of the coil component 1 is mounted on the mounting board 120, the magnetic flux leakage to the mounting board 120 side of the coil component 1 can be suppressed to acquire a desired inductance. Additionally, by suppressing the magnetic flux leakage to the mounting board 120 side of the coil component 1, the magnetic coupling to wiring and another electronic component disposed on the mounting board 120 can be suppressed to acquire a desired resonance operation. As a result, wiring and an electronic component can be arranged in the vicinity of the coil component 1 so as to achieve a reduction in size of the mounting board 120 on which the coil component 1 is mounted. Therefore, the thickness detection apparatus 100 can be reduced in size as a system including the coil component 1.

On the other hand, since the second surface 1*b* is the detecting surface, the magnetic resin body 40 is not disposed on the detecting surface 1*b* side of the coil conductors 21, 22. As a result, the magnetic resin body 40 does not interfere with the generation of the magnetic field from the detecting surface of the coil component 1. Therefore, when the roller 150 acting as the detected conductor is placed near the detecting surface of the coil component 1, the magnetic resin body 40 does not interfere with the generation of the magnetic field to the roller 150 side of the coil component 1 and does not reduce the sensitivity of detection of distance from the roller 150 by the coil component 1.

Since the magnetic resin body 40 entirely covers the first surface 1*a* side of the insulation resin body 40, the magnetic resin body 40 can suppress the magnetic flux leakage from the first surface 1*a* of the coil component 1. The magnetic resin body 40 may at least partially cover the first surface 1*a* side of the insulation resin body 40.

According to the coil component 1, the external terminals 26 partially overlap with portions of the first and second coil conductors 21, 22 when viewed in the central axis direction of the coil conductors 21, 22. The external terminals are normally formed of conductors and block the magnetic fluxes, therefore reducing an inductance of a coil when overlapping with a coil conductor. On the other hand, since the coil component 1 allows the magnetic fluxes to pass through the magnetic resin body 40, the external terminals 26 formed outside of the magnetic resin body 40 do not block the magnetic fluxes and do not reduce the inductance even when overlapping with the coil conductor 21, 22 viewed in the central axis direction of the coil conductor 21, 22. As a result, the coil conductors 21, 22 can be disposed even at the positions overlapping with the external terminals 26, and a proportion of the coil conductors to a certain outer shape can be increased. This means that a reduction can be made in proportion of an outer circumference portion of the insulation resin body without the coil conductors, i.e., a portion of the coil component 1 prone to warpage, and this configuration can further suppress the warpage of the coil component 1. In other words, since the external terminals 26 can be disposed on a region above the coil conductor 21, 22 and the external terminals 26 can be made larger, the reliability of mounting can be increased.

According to the coil component 1, since the maximum lengths 41X, 41Y of the inner portion 41 of the magnetic resin body 40 are equal to or more than one third of the maximum lengths 35X, 35Y of the insulation resin body 35, a proportion of the inner portion 41 of the magnetic resin body 40 can be increased to further reduce the warpage of the whole of the coil component 1.

Figure 6A:
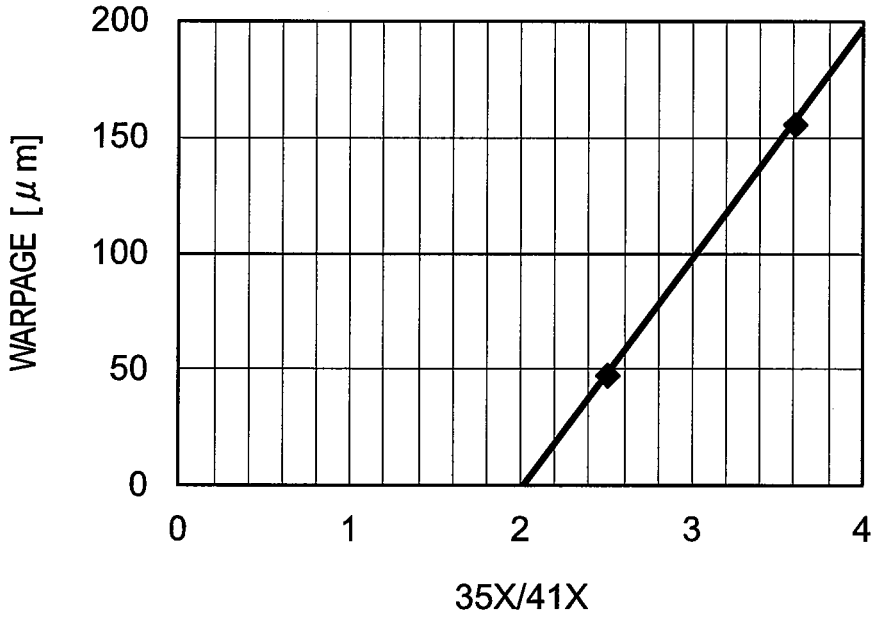
FIG. 6A is a graph of a relationship between a proportion (35X/41X) of a maximum length (35X) of an insulation resin body to a maximum length (41X) of an inner portion of a magnetic resin body and the warpage of the coil component.

FIG. 6A shows a relationship between a proportion (35X/41X) of the maximum length 35X of the insulation resin body 35X to the maximum length 41X of the inner portion 41 of the magnetic resin body 40 and the warpage of the coil component 1. A solder paste is often applied by using a mask typically having a thickness of 100 μm. It is preferable to make the warpage of the coil component 1 smaller than the solder thickness because the reliability deterioration due to solder joint defects can be reduced. From FIG. 6A, when 35X/41X is three or less (i.e., 41X/35X is ⅓ or more), the warpage is 100 μm or less. Therefore, preferably, 35X/41X is three or less.

According to the coil component 1, since the minimum distances x1, x2 are 900 μm or less between the outer surface 35*a* of the insulation resin body 35 and the outer surfaces 21*a*, 22*a* of the first and second coil conductors 21, 22, a proportion of the coil conductors 21, 22 can be increased in the outer circumference side of the inner diameter hole part 35*a* in which the warpage comparatively easily occurs, and the warpage of the coil component 1 can be reduced. Since the minimum distances x1, x2 are 25 μm or more, between the outer surface 35*a* of the insulation resin body 35 and the outer surfaces 21*a*, 22*a* of the first and second coil conductors 21, 22, the first and second coil conductors 21, 22 can be prevented from being exposed from the insulation resin body 35 due to dicing.

Figure 6B:
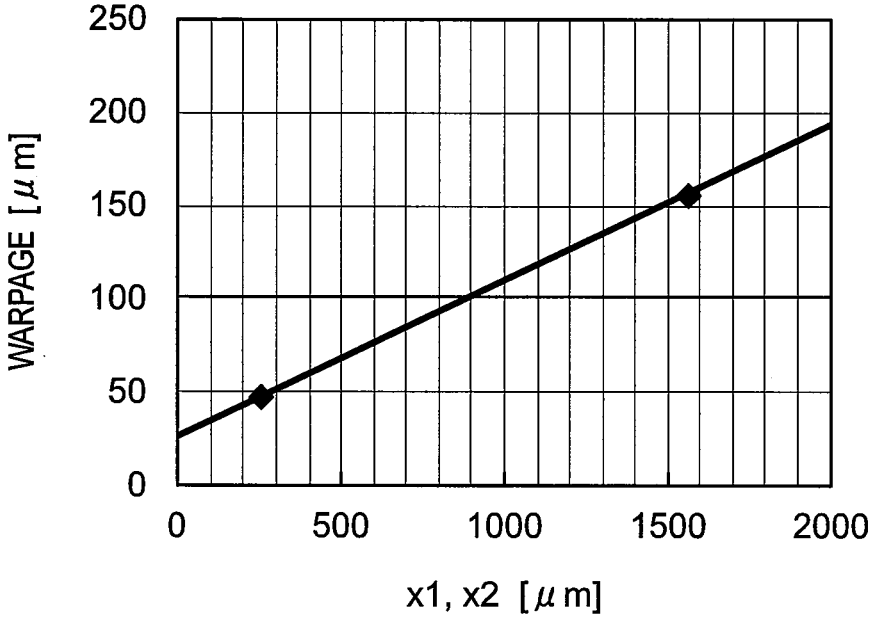
FIG. 6B is a graph of a relationship between a minimum distance (x1, x2) from an outer surface of the insulation resin body to an outer surface of the first coil conductor and the warpage of the coil component.

FIG. 6B shows a relationship between the minimum distances x1, x2 from the outer surface 35*a* of the insulation resin body to the outer surface 21*a* of the first coil conductor 21 and the warpage of the coil component 1. From FIG. 6B, when the minimum distances x1, x2 are 900 μm or less, the warpage occurring in the coil component 1 is equal to or less than a typical solder thickness of 100 μm. Therefore, it is preferable to set the minimum distances x1, x2 to 900 μm or less because the reliability deterioration due to solder joint defects can be reduced. on the other hand, when the minimum distances x1, x2 are less than 25 μm, the first and second coil conductors 21, 22 may be exposed from the insulation resin body 35 due to misalignment at the time of dicing etc.

Second Embodiment

Figure 7:
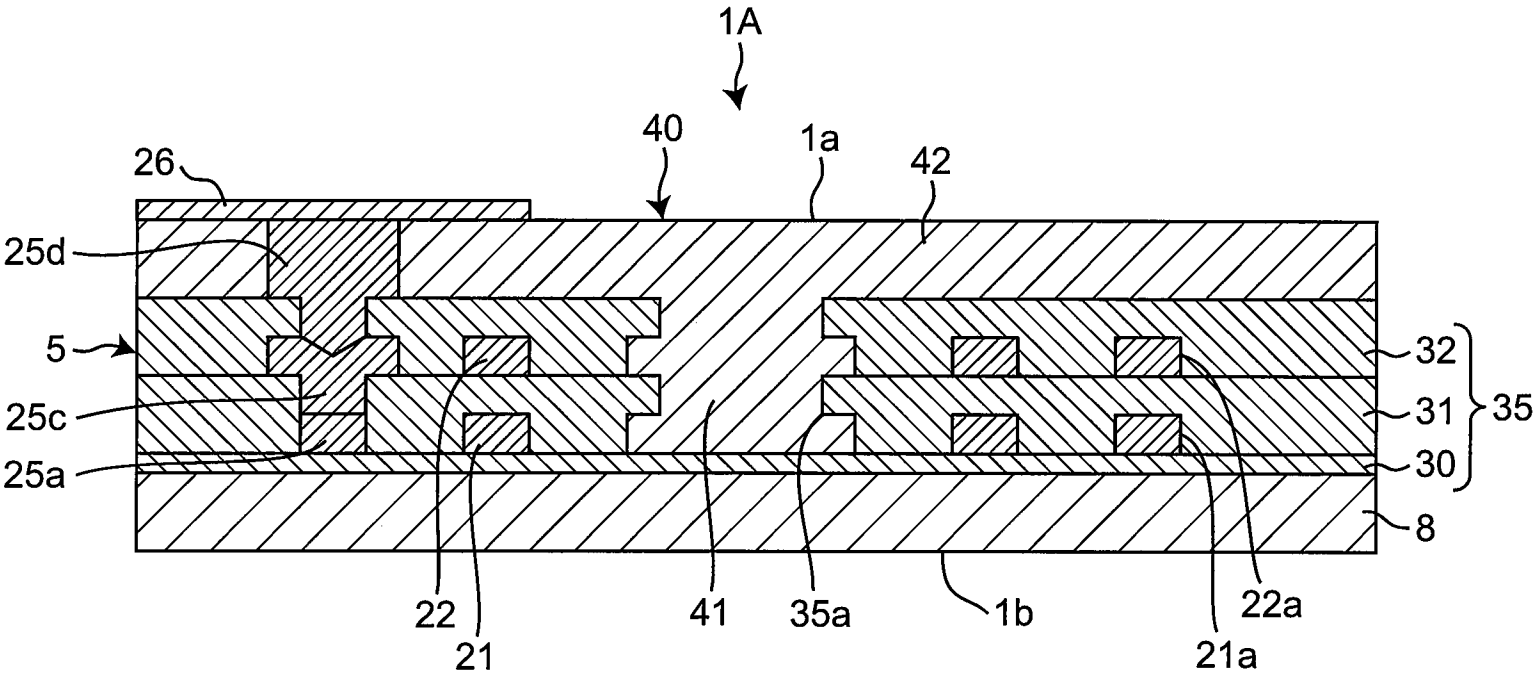
FIG. 7 is a cross-sectional view of a second embodiment of the coil component.

FIG. 7 is a cross-sectional view of a second embodiment of the coil component of the present disclosure. The second embodiment is different from the first embodiment in a configuration of a warpage prevention film. In the second embodiment, the same constituent elements as the first embodiment are denoted by the same reference numerals as the first embodiment and therefore will not be described.

As shown in FIG. 7, a coil component 1A of the second embodiment is provided with a warpage prevention film 8 on the second surface 1*b* side of the insulation resin body 35. The difference in thermal expansion coefficient of the warpage prevention film 8 and the magnetic resin body 40 is smaller than the difference in thermal expansion coefficient of the magnetic resin body 40 and the insulation resin body 35.

The warpage prevention film 8 contains a glass filler. The thermal expansion coefficient of the warpage prevention film 8 is, for example, 20 or less, and the magnetic permeability of the warpage prevention film 8 is one. The magnetic permeability of the warpage prevention film 8 is desirably smaller than the magnetic permeability of the magnetic resin body 40.

A method of manufacturing the coil component 1A will be described.

The same method as the first embodiment is performed from FIG. 5A to FIG. 5L.

Figure 8A:
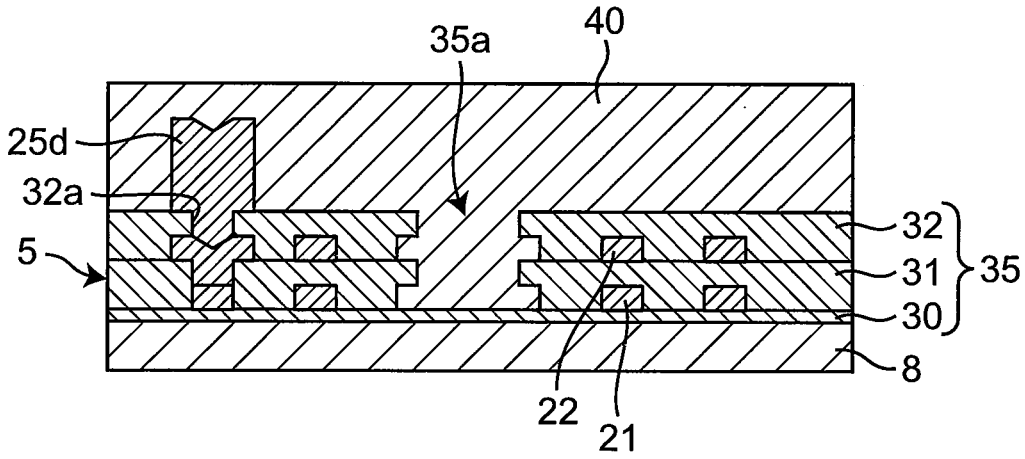
FIG. 8A is an explanatory view for explaining a second embodiment of the manufacturing method of the coil component of the present disclosure.

Subsequently, as shown in FIG. 8A, one surface of the coil substrate 5 on the second insulation resin 32 side is covered with the magnetic resin body 40, and the other surface of the coil substrate 5 on the base insulation resin 30 side is covered with the warpage prevention film 8. In this case, a plurality of sheets of the shaped magnetic resin body 40 and the one 40-μm warpage prevention film 8 are disposed on one surface of the coil substrate 5 and the other surface of the coil substrate 5, respectively, are heated and press-bonded by a vacuum laminator or a vacuum press machine, and are subsequently subjected to cure treatment. The magnetic resin body 40 and the warpage prevention film 8 may separately be formed. The magnetic resin body 40 is filled into the inner diameter hole part 35*a* of the insulation resin body 35 to make up the inner magnetic path and is disposed on one surface of the insulation resin body 35 to make up the outer magnetic path.

Figure 8B:
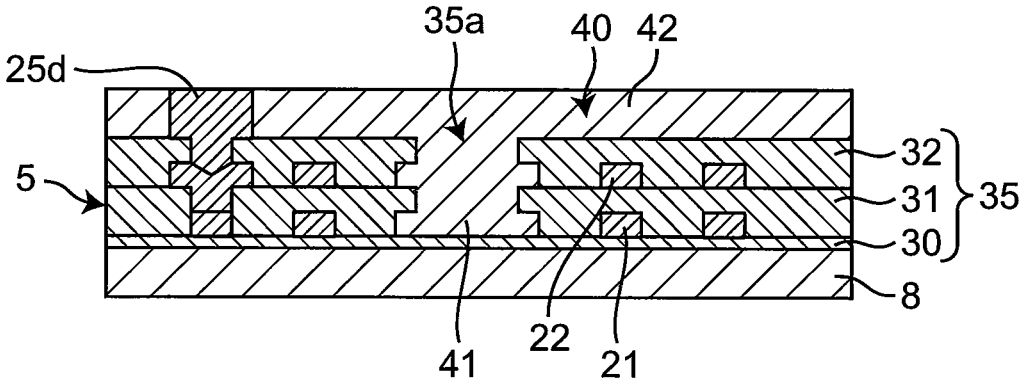
FIG. 8B is an explanatory view for explaining the second embodiment of the manufacturing method of the coil component of the present disclosure.

As shown in FIG. 8B, the magnetic resin body 40 is subjected to grinding by a back grinder etc. to adjust chip thickness. In this case, an upper part of the outer circumferential connection wiring 25*d* is exposed.

Figure 8C:
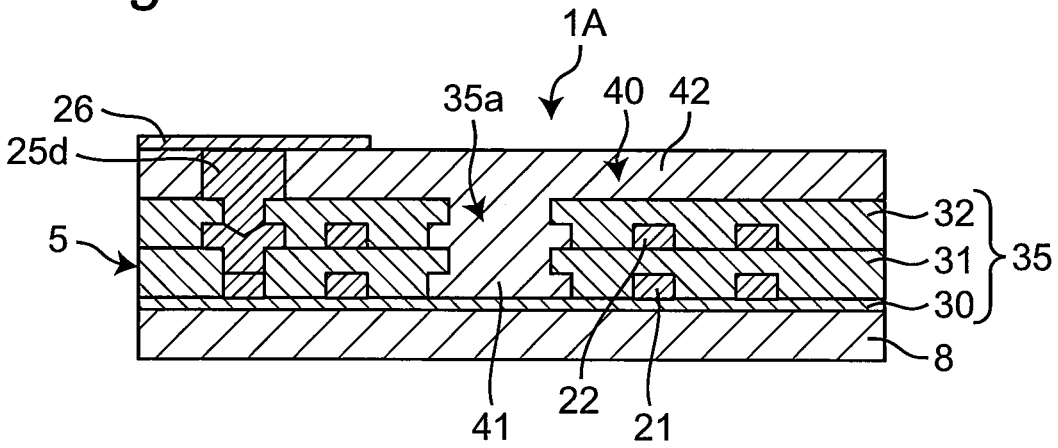
FIG. 8C is an explanatory view for explaining the second embodiment of the manufacturing method of the coil component of the present disclosure.

As shown in FIG. 8C, on one surface of the magnetic resin body 40, the external terminal 26 is disposed and connected to the outer circumferential connection wiring 25*d*. The external terminal 26 is formed by application of a resin electrode with dispersed metal microparticles by screen printing followed by dry-curing. Subsequently, after a dicer etc. are used for cutting into individual chips, a Ni/Sn plating coating film is formed on the external terminal 26 to acquire the coil component 1A.

According to the coil component 1A, in addition to the effect of the first embodiment, since the difference in thermal expansion coefficient of the warpage prevention film 8 and the magnetic resin body 40 is smaller than the difference in thermal expansion coefficient of the magnetic resin body 40 and the insulation resin body 35, the insulation resin body 35 can be interposed between the warpage prevention film 8 and the magnetic resin body 40 having the small difference in thermal expansion coefficient and the warpage of the whole of the coil component 1A can further be reduced. Even the warpage prevention film 8 having the thickness made thinner than that of the insulation resin body or that of the magnetic resin body 40 contributes to the reduction of the warpage.

Since the warpage prevention film 8 has the magnetic permeability lower than that of the magnetic resin body 40, the warpage prevention film 8 does not interfere with the generation of the magnetic field from the second surface 1*b* of the coil component 1A.

Since the warpage prevention film 8 contains the glass filler, the thermal expansion coefficient of the warpage prevention film 8 can be made smaller than the thermal expansion coefficient of the insulation resin body 35, and the magnetic permeability of the warpage prevention film 8 can be made smaller than the magnetic permeability of the magnetic resin body 40.

Third Embodiment

Figure 9:
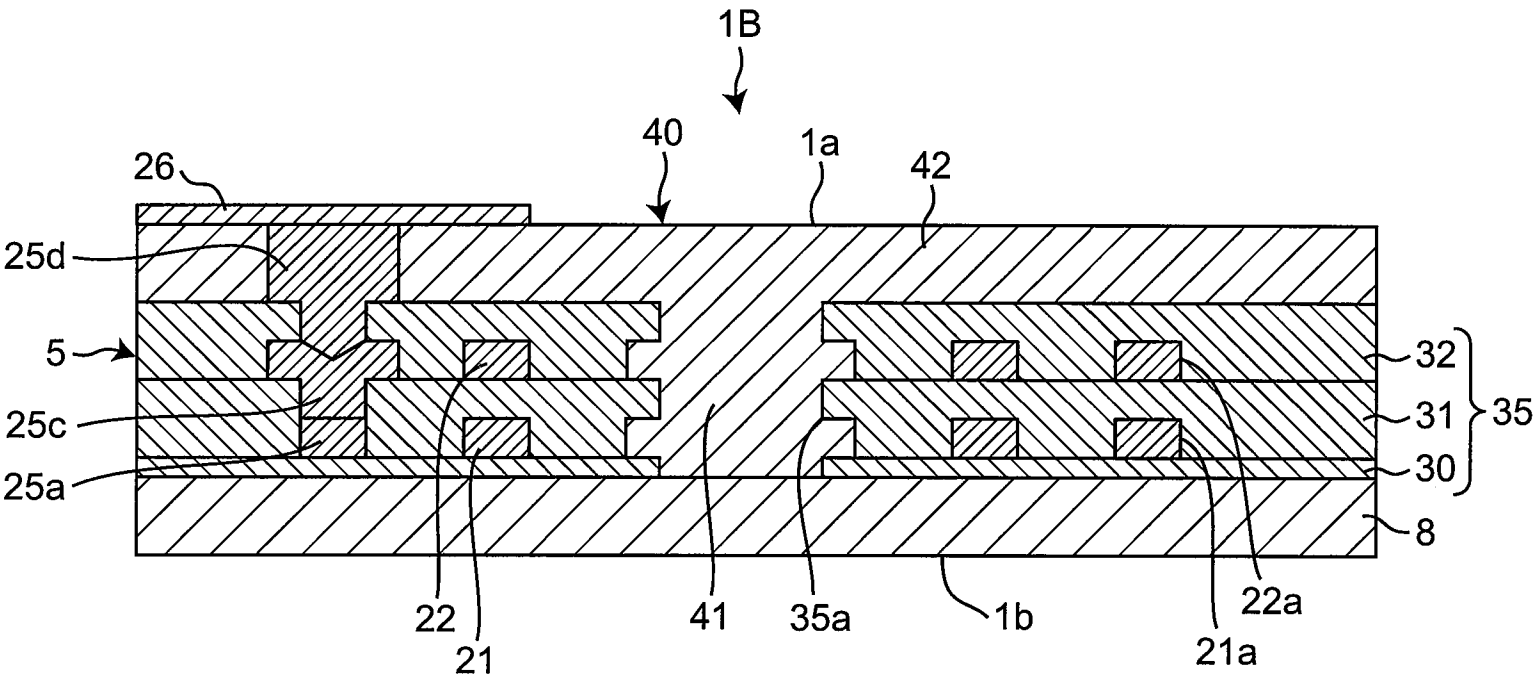
FIG. 9 is cross-sectional view of a third embodiment of the coil component.

FIG. 9 is a cross-sectional view of a third embodiment of the coil component of the present disclosure. The third embodiment is different from the second embodiment in the configurations of the magnetic resin body and the insulation resin body. In the third embodiment, the same constituent elements as the second embodiment are denoted by the same reference numerals as the second embodiment and therefore will not be described.

As shown in FIG. 9, a coil component 1B of the third embodiment has the magnetic resin body 40 penetrating the insulation resin body 35 to the second surface 1*b* side and contacting with the warpage prevention film 8. In particular, the inner diameter hole part 35*a* of the insulation resin body 35 is made up of the first and second insulation resins 31, 32 and the hole part of the base insulation resin 30. The inner portion 41 of the magnetic resin body 40 penetrates the inner diameter hole part 35*a* and contacts with the warpage prevention film 8.

A method of manufacturing the coil component 1B will be described.

The same method as the first embodiment is performed from FIG. 5A to FIG. 5I.

Figure 10A:
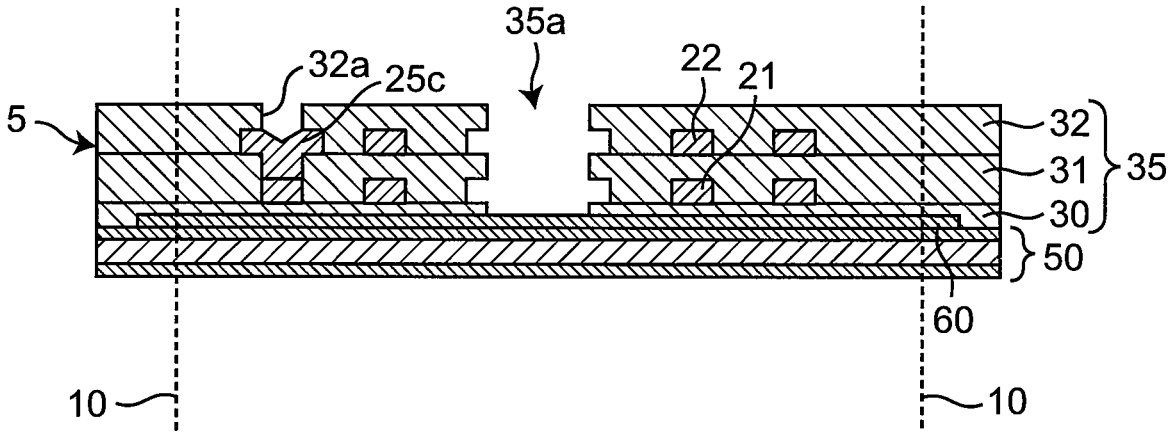
FIG. 10A is an explanatory view for explaining a third embodiment of the manufacturing method of the coil component of the present disclosure.

As shown in FIG. 10A, the via hole 32*a* is disposed in a portion of the second insulation resin 32 to expose the outer circumferential connection wiring 25*c* on the same layer as the second coil conductor 22. The base insulation resin 30 is opened by laser etching. An end part of the coil substrate 5 is cut off along the cutline 10 together with an end part of the base 50. The cutline 10 is located on the inner side of an end surface of the dummy metal layer 60.

Figure 10B:
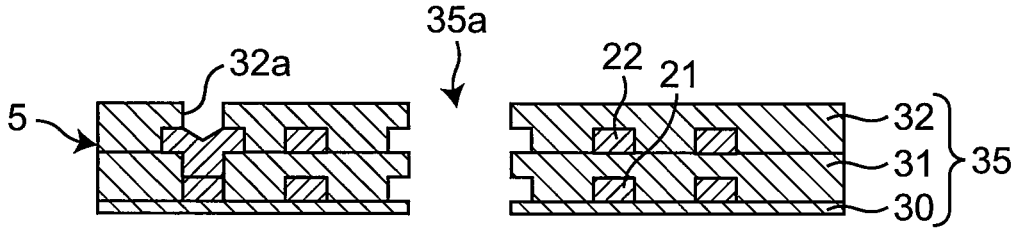
FIG. 10B is an explanatory view for explaining the third embodiment of the manufacturing method of the coil component of the present disclosure.

As shown in FIG. 10B, the base 50 is peeled off from the dummy metal layer 60 on the bonding plane between the surface of the base 50 (the base metal layer 52) and the dummy metal layer 60 and the dummy metal layer 60 is removed by etching.

Figure 10C:
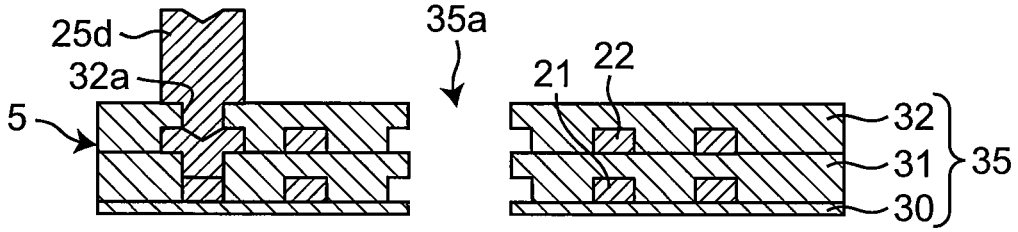
FIG. 10C is an explanatory view for explaining the third embodiment of the manufacturing method of the coil component of the present disclosure.

As shown in FIG. 10C, the outer circumferential connection wiring 25*d* is disposed in the via hole 32*a* of the second insulation resin 32 to connect the outer circumferential connection wiring 25*d* to the outer circumferential connection wiring 25*c* on the same layer as the second coil conductor 22. The outer circumferential connection wiring 25*d* is formed by the semi-additive process.

Figure 10D:
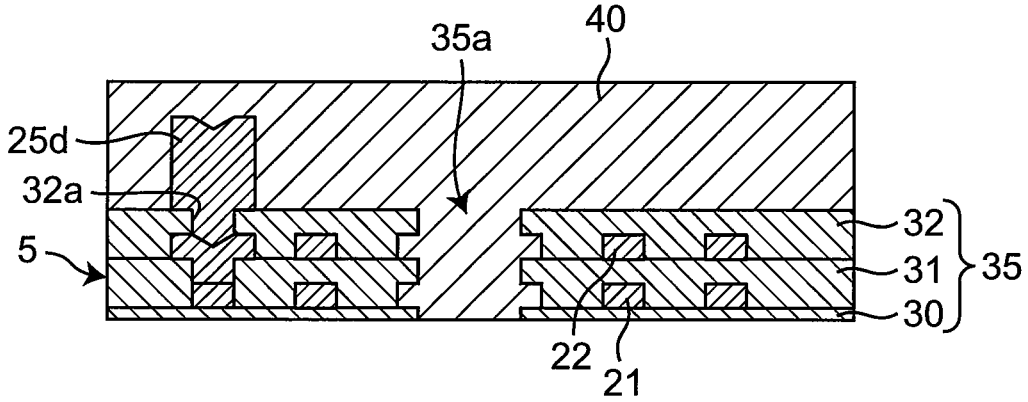
FIG. 10D is an explanatory view for explaining the third embodiment of the manufacturing method of the coil component of the present disclosure.

As shown in FIG. 10D, one surface of the coil substrate on the second insulation resin 32 side is covered with the magnetic resin body 40. In this case, a plurality of sheets of the shaped magnetic resin body 40 is disposed on one side of the coil substrate 5 in the lamination direction, is heated and press-bonded by a vacuum laminator or a vacuum press machine, and is subsequently subjected to cure treatment. The magnetic resin body 40 is filled into the inner diameter hole part 35*a* of the insulation resin body 35 to make up the inner magnetic path and is disposed on one surface of the insulation resin body 35 to make up the outer magnetic path.

Figure 10E:
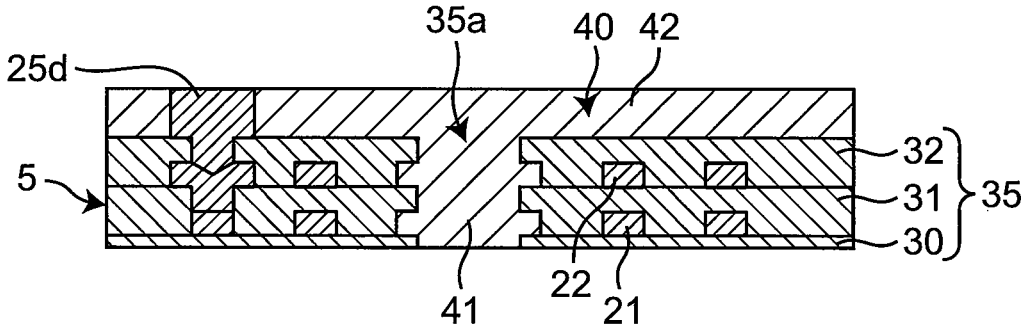
FIG. 10E is an explanatory view for explaining the third embodiment of the manufacturing method of the coil component of the present disclosure.

As shown in FIG. 10E, the magnetic resin body 40 is subjected to grinding by a back grinder etc. to adjust chip thickness. In this case, an upper part of the outer circumferential connection wiring 25*d* is exposed.

Figure 10F:
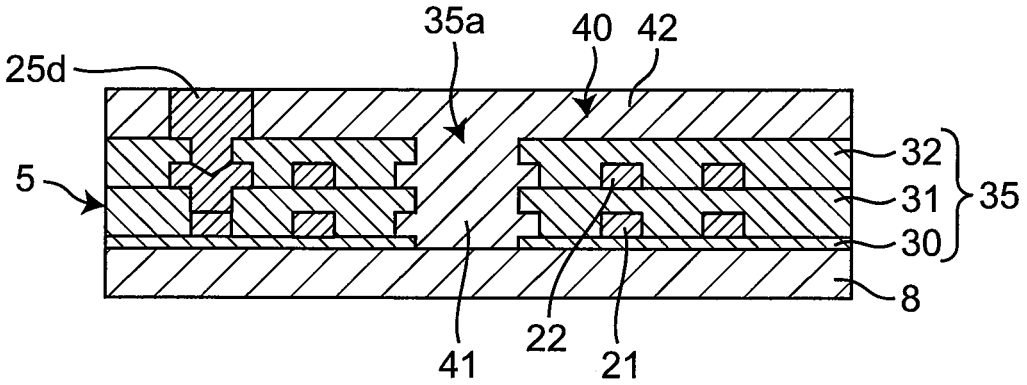
FIG. 10F is an explanatory view for explaining the third embodiment of the manufacturing method of the coil component of the present disclosure.

As shown in FIG. 10F, one surface of the coil substrate 5 on the base insulation resin 30 side is covered with the warpage prevention film 8. In this case, the one 40-μm warpage prevention film 8 is disposed on the one surface of the coil substrate 5, is heated and press-bonded by a vacuum laminator or a vacuum press machine, and is subsequently subjected to cure treatment.

Figure 10G:
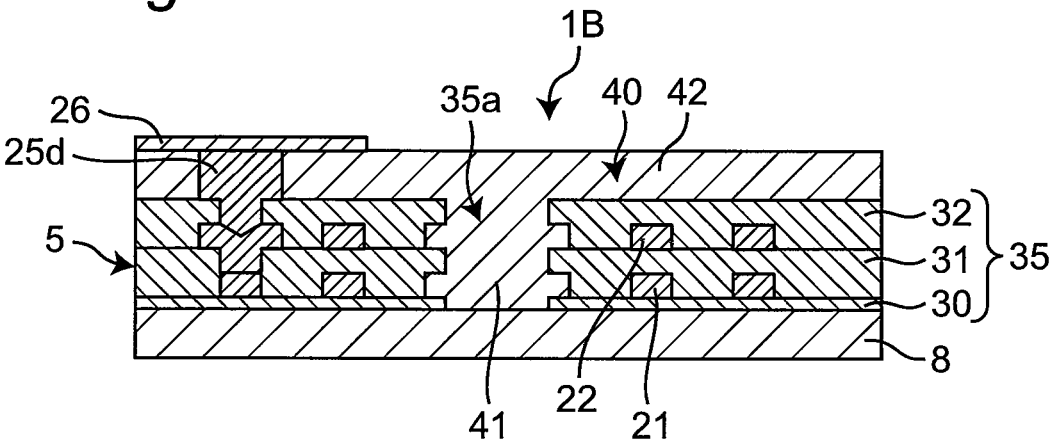
FIG. 10G is an explanatory view for explaining the third embodiment of the manufacturing method of the coil component of the present disclosure.

As shown in FIG. 10G, on one surface of the magnetic resin body 40, the external terminal 26 is disposed and connected to the outer circumferential connection wiring 25*d*. The external terminal 26 is formed by application of a resin electrode with dispersed metal microparticles by screen printing followed by dry-curing. Subsequently, after a dicer etc. are used for cutting into individual chips, a Ni/Sn plating coating film is formed on the external terminal 26 to acquire the coil component 1B.

According to the coil component 1B, in addition to the effect of the second embodiment, the magnetic resin body 40 penetrates the insulation resin body 35 to the second surface 1*b* side and contacts with the warpage prevention film 8. In this case, the base insulation layer 30 is no longer present in the process of manufacturing in the inner magnetic path portion most susceptible to fracturing during peeling of the base 50 and, therefore, the base insulation layer 30 can be made thinner to reduce the height of the coil component 1B.

Fourth Embodiment

Figure 11:
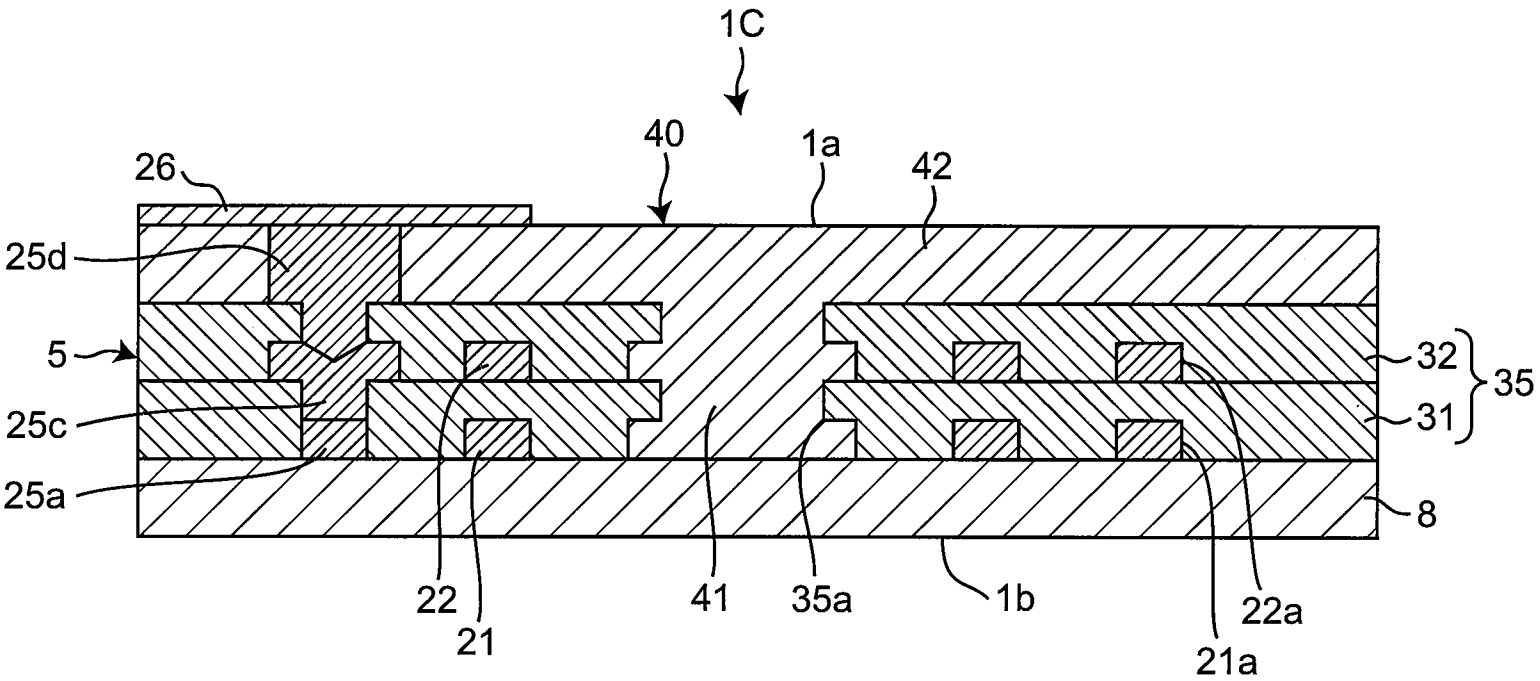
FIG. 11 is a cross-sectional view of a fourth embodiment of the coil component.

FIG. 11 is a cross-sectional view of a fourth embodiment of the coil component of the present disclosure. The fourth embodiment is different from the third embodiment in the configuration of the insulation resin body. In the fourth embodiment, the same constituent elements as the third embodiment are denoted by the same reference numerals as the third embodiment and therefore will not be described.

As shown in FIG. 11, in the coil component 1C of the fourth embodiment, the first coil conductor 21 contacts with the warpage prevention film 8. In particular, the insulation resin body 35 does not include the base insulation resin 30 (see FIG. 9) underlying the first coil conductor 21, and the first coil conductor 21 is exposed from the lower surface of the insulation resin body 35. In a method of manufacturing the coil component 1C, when the base insulation resin 30 is laminated on the dummy metal layer 60 of the third embodiment, the warpage prevention film 8 is laminated instead of the base insulation resin 30 by a vacuum laminator and is then thermally cured.

According to the coil component 1C, in addition to the effect of the third embodiment, since the first coil conductor 21 contacts with the warpage prevention film 8, i.e., the base insulation resin 30 can be eliminated, the coil component 1C can further be reduced in height.

Fifth Embodiment

Figure 12:
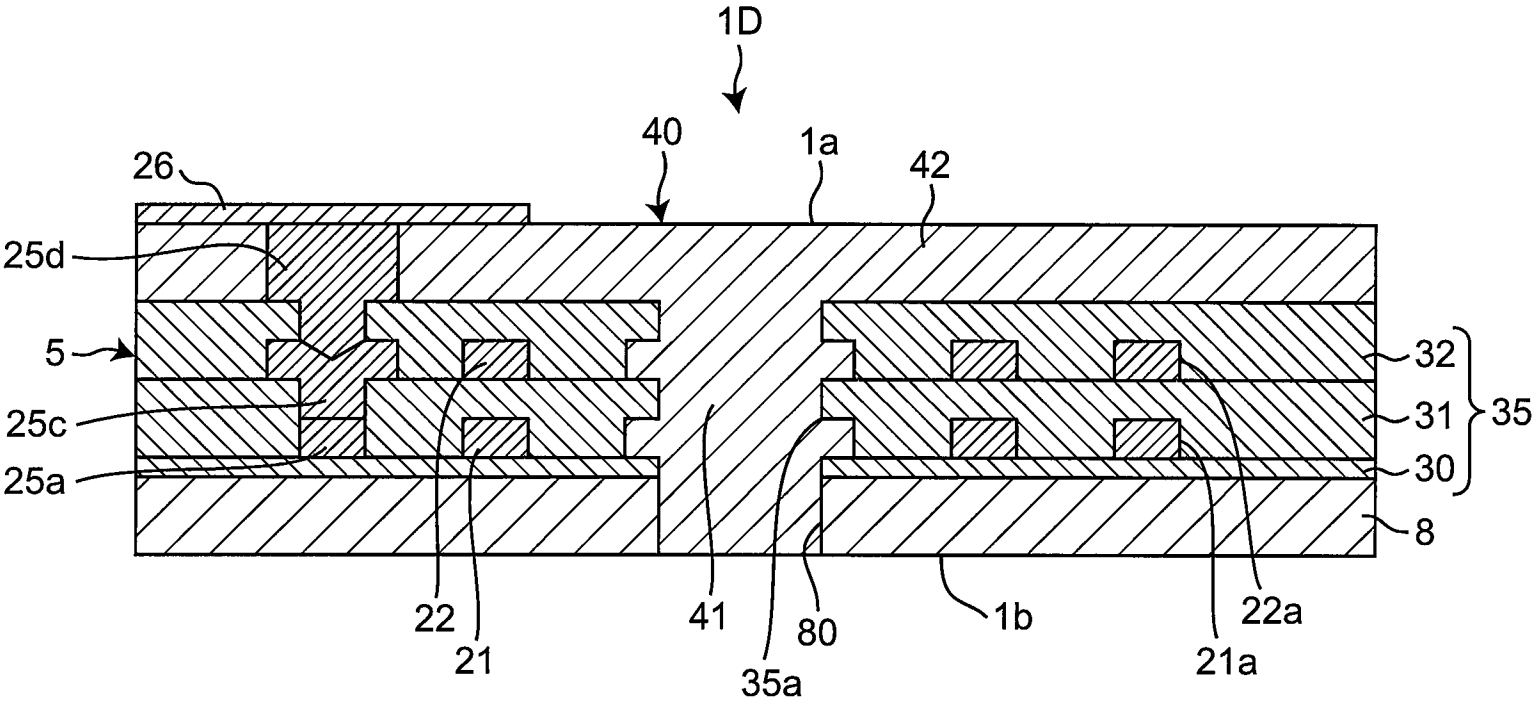
FIG. 12 is a cross-sectional view of a fifth embodiment of the coil component.

FIG. 12 is a cross-sectional view of a fifth embodiment of the coil component of the present disclosure. The fifth embodiment is different from the third embodiment in the configurations of the magnetic resin body and the warpage prevention film. In the fifth embodiment, the same constituent elements as the third embodiment are denoted by the same reference numerals as the third embodiment and therefore will not be described.

As shown in FIG. 12, in a coil component 1D of the fifth embodiment, the magnetic resin body 40 penetrates the insulation resin body 35 and the warpage prevention film 8 to the second surface 1*b* side. Therefore, the warpage prevention film 8 has an opening part 80 overlapping with the inner diameter hole part 35*a* when viewed in the central axis direction of the coil conductors 21, 22. The inner portion 41 of the magnetic resin body 40 penetrates the inner diameter hole part 35*a* and the opening part 80.

According to the coil component 1D, in addition to the effect of the third embodiment, the magnetic resin body 40 penetrates the insulation resin body 35 and the warpage prevention film 8 to the second surface 1*b* side, and the warpage prevention film 8 does not interfere with the generation of the magnetic field from the second surface 1*b* of the coil component 1D. This leads to an increase in degree of freedom of material selection of the warpage prevention film 8.

Sixth Embodiment

Figure 13:
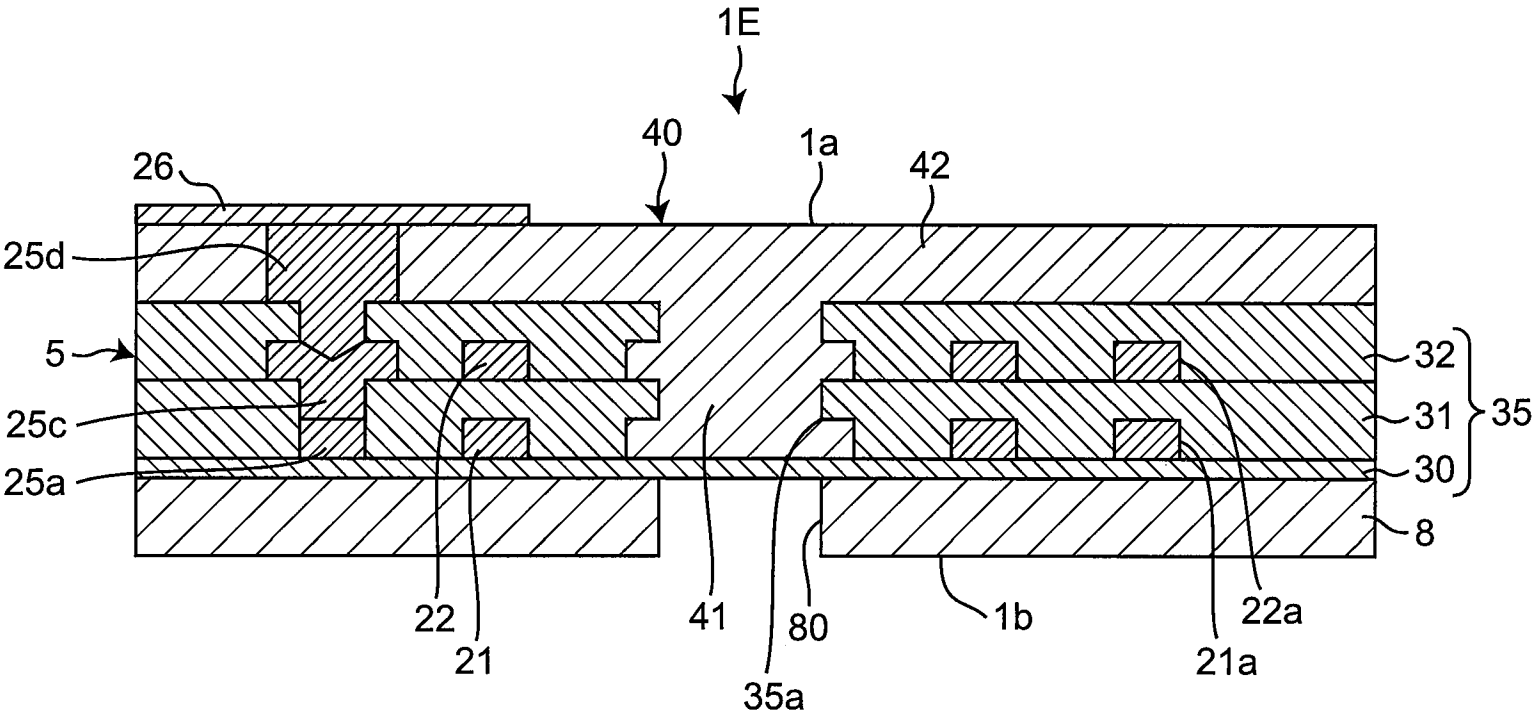
FIG. 13 is a cross-sectional view of a sixth embodiment of the coil component.

FIG. 13 is a cross-sectional view of a sixth embodiment of the coil component of the present disclosure. The sixth embodiment is different from the second embodiment in the configuration of the warpage prevention film. In the sixth embodiment, the same constituent elements as the second embodiment are denoted by the same reference numerals as the second embodiment and therefore will not be described.

As shown in FIG. 13, in a coil component 1E of the sixth embodiment, the warpage prevention film 8 has the opening part 80 overlapping with the magnetic resin body 35 in the inner diameter hole part 35*a* when viewed in the central axis direction of the coil conductors 21, 22. In particular, the opening part 80 of the warpage prevention film 8 has the same size as the inner diameter hole part 35*a* of the insulation resin body 35 when viewed in the central axis direction of the coil conductors 21, 22. The opening part 80 may be larger than the inner diameter hole part 35*a*.

A method of manufacturing the coil component coil component 1E will be described.

The same method as the second embodiment is performed to FIG. 8B.

Figure 14A:
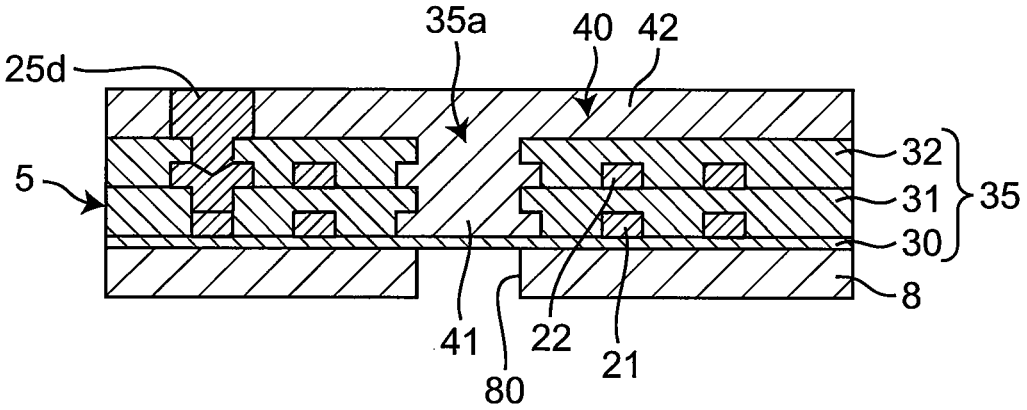
FIG. 14A is an explanatory view for explaining a sixth embodiment of the manufacturing method of the coil component of the present disclosure.

Subsequently, as shown in FIG. 14A, the warpage prevention film 8 is opened by a laser etc. from the back surface of the coil substrate 5. In this case, no problem is caused even when the base insulation resin 30 directly above the opening part 80 of the warpage prevention film 8 is also opened. The inner portion 41 of the magnetic resin body 40 acts as a stopper for the laser opening. Although the opening part 80 of the warpage prevention film 8 is opened after the grinding of the magnetic resin body 40 in this example, the opening part 80 may be opened before the grinding.

Figure 14B:
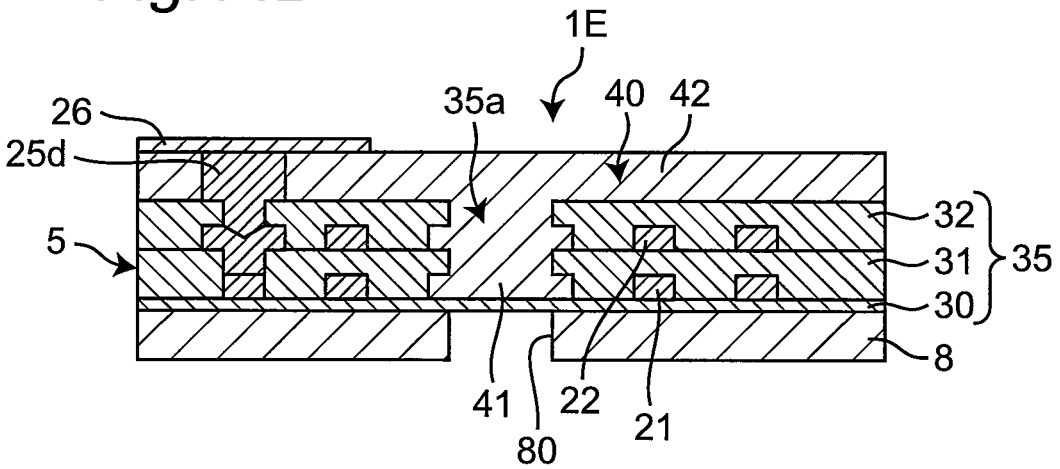
FIG. 14B is an explanatory view for explaining the sixth embodiment of the manufacturing method of the coil component of the present disclosure.

As shown in FIG. 14B, on one surface of the magnetic resin body 40, the external terminal 26 is disposed and connected to the outer circumferential connection wiring 25*d*. The external terminal 26 is formed by application of a resin electrode with dispersed metal microparticles by screen printing followed by dry-curing. Subsequently, after a dicer etc. are used for cutting into individual chips, a Ni/Sn plating coating film is formed on the external terminal 26 to acquire the coil component 1E.

According to the coil component 1E, in addition to the effect of the second embodiment, since the warpage prevention film 8 has the opening part 80 overlapping with the inner portion 41 of the magnetic resin body 40 when viewed in the central axis direction of the coil conductors 21, 22, the warpage prevention film 8 does not interfere with the generation of the magnetic field from the second surface 1*b* of the coil component 1E regardless of the magnetic permeability of the warpage prevention film 8. This leads to an increase in degree of freedom of material selection of the warpage prevention film 8. When the opening part 80 is larger than the inner diameter hole part 35*a* (the inner portion 41), the interference with the generation of the magnetic field can further be prevented.

Seventh Embodiment

Figure 15:
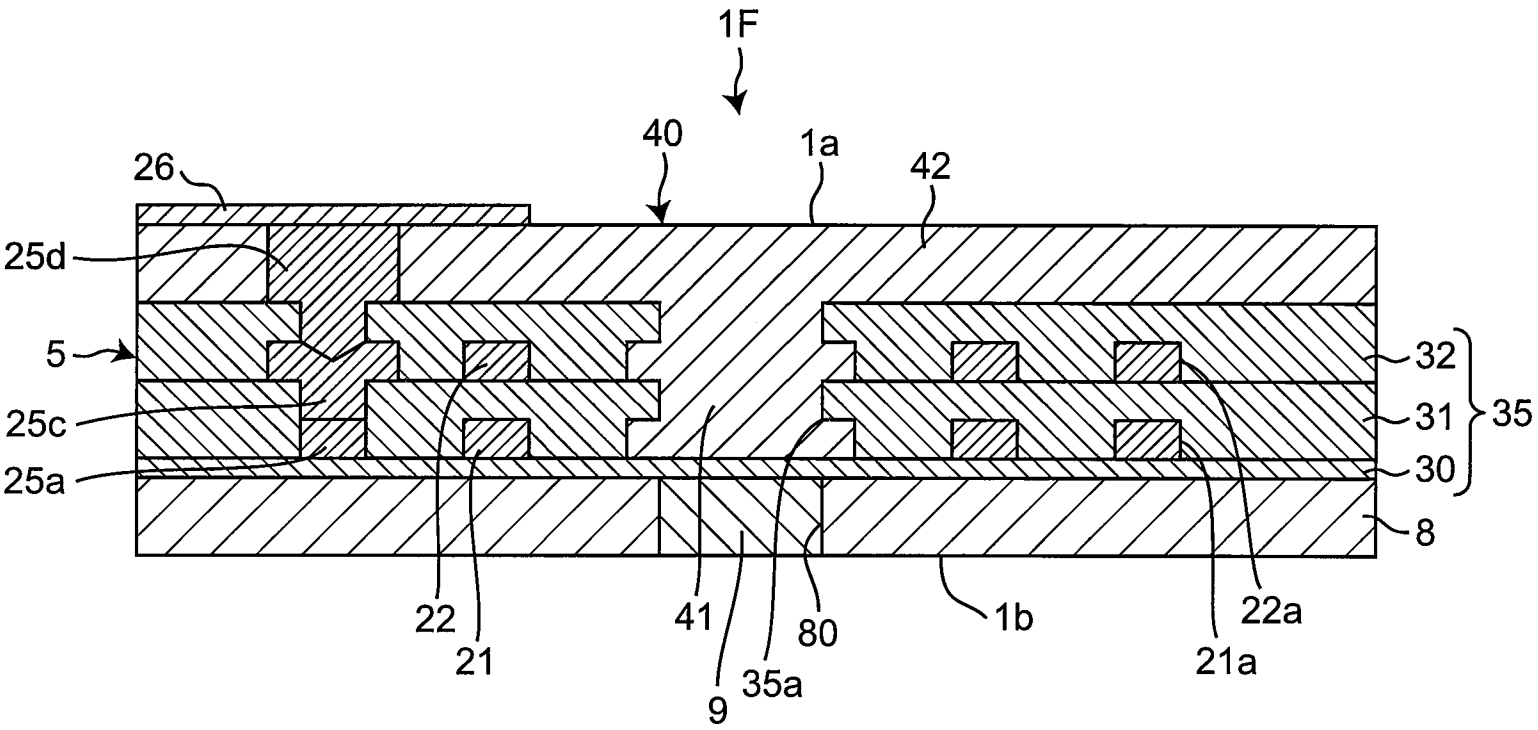
FIG. 15 is a cross-sectional view of a seventh embodiment of the coil component.

FIG. 15 is a cross-sectional view of a seventh embodiment of the coil component of the present disclosure. The seventh embodiment is different from the sixth embodiment in the configuration of the warpage prevention film. In the seventh embodiment, the same constituent elements as the sixth embodiment are denoted by the same reference numerals as the sixth embodiment and therefore will not be described.

As shown in FIG. 15, in a coil component 1F of the seventh embodiment, a magnetic material 9 is disposed in the opening part 80 of the warpage prevention film 8. The magnetic material 9 is made of the same material as the magnetic resin body 40, for example.

According to the coil component 1F, since the magnetic material 9 is disposed in the opening part 80 of the warpage prevention film 8, the L-value and the Q-value can be increased without making the warpage of the coil component 1F larger. Additionally, entry of water etc. can be suppressed to improve the reliability of the coil component 1F. An insulation material may be disposed instead of the magnetic material 9 in the opening part 80. The insulation material is made of the same material as the insulation resin body 35.

The present disclosure is not limited to the embodiments and may be changed in design without departing from the spirit of the present disclosure. For example, respective feature points of the first to seventh embodiments may variously be combined.

Although the maximum lengths and the minimum distances of the insulation resin body, the inner portion of the magnetic resin body, and the coil conductors are specified in the X direction and the Y direction in the embodiments, this is not a limitation, and the magnetic resin body may be disposed in the inner diameter hole part of the insulation resin body so as to reduce the warpage of the whole of the coil component.

Although two layers of coil conductors are disposed as the coil component in the embodiments, one layer or three or more layers of the coil conductors may be disposed.

Although one coil conductor is disposed for each layer for the coil component in the embodiments, a plurality of coil conductors may be disposed for each layer.

Although the coil conductors of the coil component are formed into a plane spiral shape in the embodiments, the coil conductors may be formed into a cylindrical spiral shape.

Although the coil substrate is formed on one of the both surfaces of the base in the embodiments, the coil substrates may respectively be formed on both surfaces of the base. As a result, higher productivity can be achieved.

Although the coil component is used for the thickness detection apparatus in the embodiments, the coil component may be used for any apparatus detecting a distance to a detected conductor, or may be used for an apparatus other than such an apparatus. The manufacturing method of the coil component is not limited to the embodiments.

EXAMPLES

Figure 16:
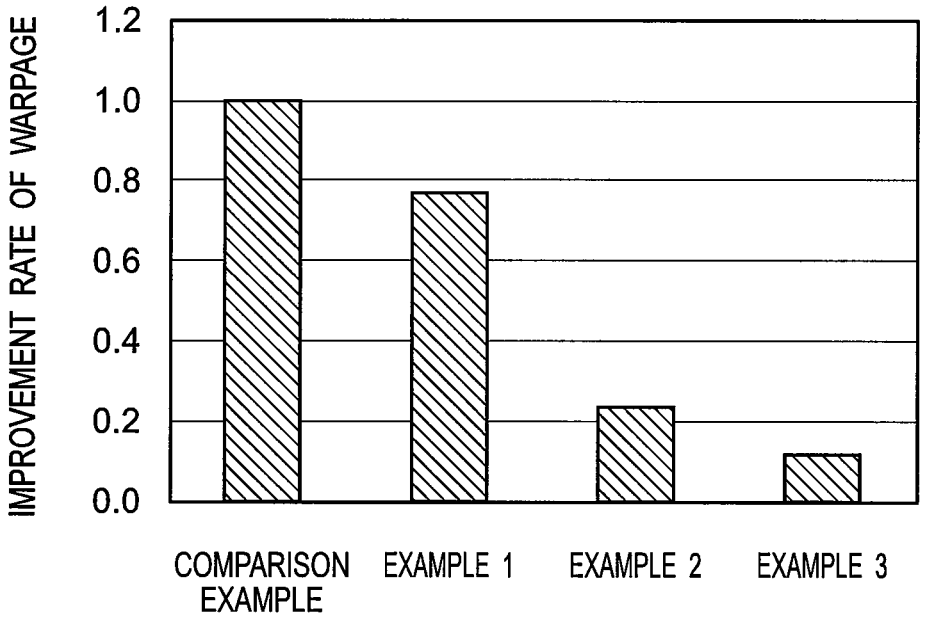
FIG. 16 is a graph showing an improvement rate of warpage in a comparison example and examples 1 to 3.

FIG. 16 shows an improvement rate of warpage in a comparison example and examples 1 to 3. The comparison example has the chip size of 8.5 mm (X direction)×6.0 mm (Y direction) and does not have the inner portion of the magnetic resin body. Therefore, a portion corresponding to the inner portion is formed of an insulation resin body.

The example 1 has the chip size of 8.5 mm×6.0 mm and has the inner portion of the magnetic resin body and, in the X direction, the maximum length of the inner portion of the magnetic resin body is less than one third of the maximum length of the insulation resin body.

The example 2 has the chip size of 5.9 mm×6.0 mm and has the inner portion of the magnetic resin body and, in the X direction and the Y direction, the magnetic maximum length of the inner portion of the resin body is equal to or greater than one third of the maximum length of the insulation resin body. Therefore, the example 2 corresponds to the first embodiment.

The example 3 has the chip size of 5.9 mm×6.0 mm and has the inner portion of the magnetic resin body and, in the X direction and the Y direction, the magnetic maximum length of the inner portion of the resin body is equal to or greater than one third of the maximum length of the insulation resin body, and the warpage prevention film is included. Therefore, the example 2 corresponds to the sixth embodiment.

As shown in FIG. 16, when the warpages of the chips are measured in the X direction and the warpage of the chip of the comparison example is assumed as one, the improvement rate of the warpage of the example 1 is approximately 0.75; the improvement rate of the warpage of the example 2 is approximately 0.2; and the improvement rate of the warpage of the example 3 is approximately 0.1. As described above, the improvement rate of the warpage becomes better in order of the examples 1 to 3.

The invention claimed is:

1. A coil component having a first surface and a second surface facing each other, comprising:

a coil conductor formed into a spiral shape and having a central axis intersecting with the first surface and the second surface;

an insulation resin body covering the coil conductor and including an inner diameter hole part corresponding to the central axis of the coil conductor; and a magnetic resin body disposed on the first surface side of the insulation resin body without being disposed on the second surface side of the insulation resin body; wherein the magnetic resin body is also disposed inside the inner diameter hole part of the insulation resin body, the magnetic resin body is covered by the insulation resin body on the second surface of the insulation resin body at the inner diameter hole part, the inner diameter hole part includes a step portion, and an inner diameter of a first portion of the inner diameter hole part is larger than an inner diameter of a second portion of the inner diameter hole part that is further from the second surface than the first portion.

2. The coil component according to claim 1, wherein the magnetic resin body entirely covers the first surface side of the insulation resin body.

3. The coil component according to claim 1, wherein the first surface is a mounting surface that is a side mounted on a mounting board, and wherein the second surface is a detecting surface that is a side facing a detected conductor.

4. The coil component according to claim 1, wherein the insulation resin body has a lower magnetic permeability and a higher thermal expansion coefficient than the magnetic resin body.

5. The coil component according to claim 1, wherein the thermal expansion coefficient of the coil conductor is larger than the thermal expansion coefficient of the magnetic resin body and smaller than the thermal expansion coefficient of the insulation resin body.

6. The coil component according to claim 1, wherein the insulation resin body has an outer shape that is a quadrangular shape having one side direction and another side direction when viewed in the central axis direction, and wherein in at least one of the one side direction and the other side direction, the maximum length of the magnetic resin body in the inner diameter hole part is equal to or greater than one third of the maximum length of the insulation resin body.

7. The coil component according to claim 6, wherein the one side direction or the other side direction is a longitudinal direction, and wherein in the longitudinal direction, the maximum length of the magnetic resin body in the inner diameter hole part is equal to or greater than one third of the maximum length of the insulation resin body.

8. The coil component according to claim 1, wherein the insulation resin body has an outer shape that is a quadrangular shape having one side direction and another side direction when viewed in the central axis direction, and wherein in at least one of the one side direction and the other side direction, the minimum distance between an outer surface of the insulation resin body and an outer surface of the coil conductor is 25 μm or more and 900 μm or less.

9. The coil component according to claim 1, wherein an external terminal connected to the coil conductor is disposed on the first surface side of the magnetic resin body, and wherein the external terminal partially overlaps with a portion of the coil conductor when viewed in the central axis direction.

10. The coil component according to claim 1, wherein a warpage prevention film is disposed on the second surface side of the insulation resin body, and wherein a difference in thermal expansion coefficient of the warpage prevention film and the magnetic resin body is smaller than a difference in thermal expansion coefficient of the magnetic resin body and the insulation resin body.

11. The coil component according to claim 10, wherein the warpage prevention film has a magnetic permeability lower than the magnetic resin body.

12. The coil component according to claim 11, wherein the warpage prevention film contains a glass filler.

13. A coil component having a first surface and a second surface facing each other, comprising:

a coil conductor formed into a spiral shape and having a central axis intersecting with the first surface and the second surface;

an insulation resin body covering the coil conductor and including an inner diameter hole part corresponding to the central axis of the coil conductor; and a magnetic resin body disposed on the first surface side of the insulation resin body without being disposed on the second surface side of the insulation resin body; wherein the magnetic resin body is also disposed inside the inner diameter hole part of the insulation resin body, the magnetic resin body is covered by the insulation resin body on the second surface of the insulation resin body at the inner diameter hole part, the inner diameter hole part includes a step portion, and an inner diameter of the inner diameter hole part at a first portion is smaller than an inner diameter of the inner diameter hole part at a second portion that is further from the second surface than the first portion in a direction along the central axis, and smaller than an inner diameter of the inner diameter hole part at a third portion that is closer to the second surface than the first portion in a direction along the central axis.

* * * * *